US008682189B2

(12) United States Patent
Shimizu

(10) Patent No.: US 8,682,189 B2
(45) Date of Patent: Mar. 25, 2014

(54) TRANSFER DEVICE AND IMAGE FORMING APPARATUS INCORPORATING TRANSFER DEVICE

(75) Inventor: Yasunobu Shimizu, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 348 days.

(21) Appl. No.: 13/158,073

(22) Filed: Jun. 10, 2011

(65) Prior Publication Data

US 2012/0008991 A1 Jan. 12, 2012

(30) Foreign Application Priority Data

Jun. 10, 2010 (JP) ..... 2010-133058
Aug. 31, 2010 (JP) ..... 2010-194913

(51) Int. Cl.
*G03G 15/16* (2006.01)
*G03G 15/01* (2006.01)

(52) U.S. Cl.
CPC ..... *G03G 15/0136* (2013.01); *G03G 15/1675* (2013.01)
USPC ..... 399/66

(58) Field of Classification Search
CPC ..... G03G 15/1675; G03G 15/0136; G03G 15/0131
USPC ..... 399/66, 313, 314
See application file for complete search history.

(56) References Cited

U.S. PATENT DOCUMENTS 5,745,820 A * 4/1998 Iwakura et al. ..... 399/45
5,758,244 A * 5/1998 Iwakura ..... 399/313
5,799,225 A * 8/1998 Abe et al. ..... 399/66
6,026,256 A * 2/2000 Abe et al. ..... 399/66
8,483,597 B2 * 7/2013 Mimbu et al. ..... 399/121
2007/0242965 A1 10/2007 Akamatsu
2010/0098446 A1 4/2010 Ishikawa et al.

(Continued)

FOREIGN PATENT DOCUMENTS

JP 06-274051 9/1994
JP 10-083124 3/1998

(Continued)

OTHER PUBLICATIONS

Machine translation of reference Fujita (JP 2001-324,841 A), Listed in IDS. Pub date Nov. 22, 2001.*

(Continued)

*Primary Examiner* — Walter L Lindsay, Jr.
*Assistant Examiner* — Rodney Bonnette
(74) *Attorney, Agent, or Firm* — Oblon, Spivak, McClelland, Maier & Neustadt, L.L.P.

(57) ABSTRACT

An image transfer system comprises an image bearer and an opposed member having a contact surface contacting a recording medium and opposed to a surface of the image bearer to form a transfer nip. A pressing device applies pressure to the transfer nip. An engaging and disengaging member engages and disengages the contact surface from the surface of the image bearer. A transfer bias device applies a transfer bias transferring an image formed on the image bearer onto the recording medium conveyed and pinched at the transfer nip. The image is composed of an adjustment pattern formed on a portion of the image bearer corresponding to an interval between recording mediums successively conveyed through the transfer nip. The engaging and disengaging device disengages the contact surface from the surface of the image bearer to form a gap therebetween when the adjustment pattern passes therethrough.

14 Claims, 14 Drawing Sheets

(56) References Cited

U.S. PATENT DOCUMENTS

| | | | | |
|---|---|---|---|---|
| 2010/0142985 | A1* | 6/2010 | Minbe et al. | 399/66 |
| 2010/0221029 | A1* | 9/2010 | Minbu et al. | 399/66 |
| 2012/0121293 | A1* | 5/2012 | Mimbu et al. | 399/121 |

FOREIGN PATENT DOCUMENTS

| | | |
|---|---|---|
| JP | 2001-324841 | 11/2001 |
| JP | 2006-047779 | 2/2006 |
| JP | 2007-286176 | 11/2007 |
| JP | 2009-145778 | 7/2009 |
| JP | 2010-204259 | 9/2010 |

OTHER PUBLICATIONS

Extended Search Report issued Sep. 23, 2011 in European Patent Application No. 11169389.1-2209.

* cited by examiner

FIG. 18

TABLE 1

| | COLOR COPY 160g/m^2 | | COLOR COPY 320g/m^2 | |
|---|---|---|---|---|
| | POOR IMAGE | BACKSIDE STEIN | POOR IMAGE | BACKSIDE STEIN |
| FIRST PRACTICAL EXAMPLE | ○ | ○ | △ | ○ |
| SECOND PRACTICAL EXAMPLE | ○ | ○ | ○ | ○ |
| THIRD PRACTICAL EXAMPLE | ○ | ○ | ○ | ○ |
| FOURTH PRACTICAL EXAMPLE | ○ | ○ | ○ | ○ |
| FIRST COMPARATIVE EXAMPLE | × | ○ | × | ○ |
| SECOND COMPARATIVE EXAMPLE | × | × | × | × |
| THIRD COMPARATIVE EXAMPLE | × | × | × | × |

TRANSFER DEVICE AND IMAGE FORMING APPARATUS INCORPORATING TRANSFER DEVICE

CROSS-REFERENCE TO RELATED APPLICATIONS

This application claims priority pursuant to 35 USC §119 to Japanese Patent Application Nos. 2010-133058 and 2010-194913 filed on Jun. 10 and Aug. 31 both 2010, respectively, the entire contents of which are hereby incorporated by reference herein.

BACKGROUND OF THE INVENTION

1. Field of the Invention

The present invention relates to a transfer device and an image forming apparatus having the transfer device that transfers an image onto a recording medium at a transfer nip formed between an image bearer and a transfer member contacting the image bearer.

2. Description of the Background Art

In an image forming apparatus which employs an engaging and disengaging mechanism capable of engaging and disengaging an opposed member from an image bearer to create a transfer nip therebetween under a prescribed bias applied from a biasing device, a linear density unevenness called an impact jitter is sometimes induced when a cardboard is used as the recording medium. Because, a load on the image bearer sharply increases and a line speed thereof largely decreases when the cardboard enters the transfer nip.

The Japanese Patent Application Laid Open No. 10-83124 (JP-10-83124-A) typically suppresses the impact jitter with a transfer roller that includes a cylindrical column roller section and shafts integrally and rotatavely protruding from both side ends thereof and rotation cams capable of providing idling rotation around the shafts. The rotation cam includes a convex at a prescribed rotation angular position to collide with one end of a photoconductive member serving as the image bearer in the shaft direction. Such collision forcibly moves the transfer roller apart from the photoconductive member against a bias force applied by a pressing device toward the photoconductive member, so that a shaft distance between the photoconductive member and the transfer roller is adjusted. When the cardboard is used as a recording medium, the shaft distance is broadened and a transfer pressure is decreased or the transfer roller is disengaged therefrom. As a result, the load on the photoconductive member, which is necessarily generated when the cardboard enters, is suppressed.

Although the sharp increase in load can be avoided by broadening the shaft distance as shown in the JP-H10-83124-A, a transfer error is likely induced due to shortage of transfer pressure. To resolve such a problem, the Japanese Patent Application Laid Open No. 06-274051 (JP-H06-274051-A) provides an image forming apparatus in that a transfer roller is disengaged from a photoconductive member by driving a rotation cam and form a small gap between the transfer roller and the photoconductive member prior to entrance of a cardboard as a recording medium into a transfer nip to suppress impact jitter. Subsequently, by stopping an operation of a solenoid after entrance of a tip of the cardboard into the above-described small gap and releasing the forcible movement of the transfer roller, and thereby subjecting the transfer roller to a biasing force of a spring that serves as a pressing device to press the transfer roller against the photoconductive member, the transfer error is suppressed by applying a sufficient transfer pressure to a recording medium during a transfer process.

It is typically known that an adjustment pattern is timely formed at a prescribed position not to be transferred onto a recording medium under a prescribed image formation condition, such as when an image formation performance is checked to stabilize image quality in an image forming apparatus that includes a transfer device that superimposes images formed on multiple image bearers onto an intermediate transfer member and transfers those at once using an opposed member opposed to the intermediate transfer member.

For example, the Japanese Patent Application Laid Open No. 2007-286176 proposes a system that forms an adjustment pattern on a portion corresponding to an interval between sheets and separates and opens a secondary transfer nip in that case.

Further, the Japanese Patent Application Laid Open No. 2009-145778 proposes a system that disengages an opposed member from an intermediate transfer member when an adjustment pattern passes through a secondary transfer nip and opens a shutter of a detection sensor so that separation of the opposed member and opening and closing of the shutter of the detection sensor are synchronized with each other. Yet further, the Japanese Patent Application Laid Open No. 2006-047779 describes a technique in that a voltage having the same polarity as toner is applied to a secondary transfer nip where an intermediate transfer member contacts a secondary transfer member and an adjustment pattern passes therethrough not to transfer the adjustment pattern onto the secondary transfer member. Such a polarity is generally opposite to that applied to execute transferring onto the intermediate transfer member.

However, the above-described conventional techniques cannot obtain a fine image.

SUMMARY OF THE INVENTION

Accordingly, an object of the present invention is to provide a novel image transfer system that comprises an image bearer and an opposed member having a contact surface contacting a recording medium and opposed to a surface of the image bearer to form a transfer nip therebetween. A pressing device is provided to apply pressure to the transfer nip. An engaging and disengaging member is provided to engage and disengage the contact surface from the surface of the image bearer. A transfer bias device is provided to apply an image transfer bias transferring an image formed on the image bearer onto the recording medium conveyed and pinched at the transfer nip. An adjustment pattern is formed on a portion of the image bearer corresponding to an interval between recording mediums successively conveyed through the transfer nip. The engaging and disengaging device disengages the contact surface from the surface of the image bearer to form a gap therebetween when the adjustment pattern passes therethrough. The transfer bias device applies a different bias than the image transfer bias when the adjustment pattern passes the gap.

In another aspect, the engaging and disengaging device includes a cam having at least two different cam portions changing a size of the gap when rotated, a cam driving device that rotates and stops the cam, and a cam controller that controls the cam driving device. The cam controller controls the cam driving device to rotate and stop the cam at a first angular position minimizing the gap when the adjustment pattern passes therethrough.

In yet another aspect, a bias controller instructs the transfer bias device to stop applying the transfer bias when the gap is formed.

In yet another aspect, the bias controller instructs the transfer bias device to apply a bias having a prescribed polarity to the transfer nip when the adjustment pattern passes therethrough. The polarity is opposite to that of an image transfer bias applied when an image is transferred onto the recording medium.

In yet another aspect, an absolute value of said opposite bias is smaller than that of the image transfer bias.

In yet another aspect, the gap is broadened repelling the opposed member against the pressure by rotating and stopping the cam at a second rotation angular position before exit of a trailing end of a former recording medium passing through the transfer nip therefrom.

In yet another aspect, the gap is narrowed by rotating and stopping the cam at a third rotation angular position before entrance of a leading end of the subsequent recording medium into the transfer nip.

In yet another aspect, the transfer bias is turned on and off synchronizing with the rotation of the cam.

In yet another aspect, the engaging and disengaging device includes a cam having at least two different cam portions changing a size of the gap when rotated, a cam driving device to rotate and stop the cam, and a cam controller to control the cam driving device. The cam controller controls the cam driving device to rotate and stop the cam at a prescribed angular position changing the gap in accordance with a thickness of the recording medium.

BRIEF DESCRIPTION OF DRAWINGS

A complete appreciation of the present invention and many of the attendant advantages thereof will be readily obtained as the same becomes better understood by reference to the following detailed description when considered in connection with the accompanying drawings, wherein:

FIG. 18 illustrates an experimental result showing sheet passage performances obtained under various conditions.

PREFERRED EMBODIMENTS OF THE PRESENT INVENTION

Figure 1:
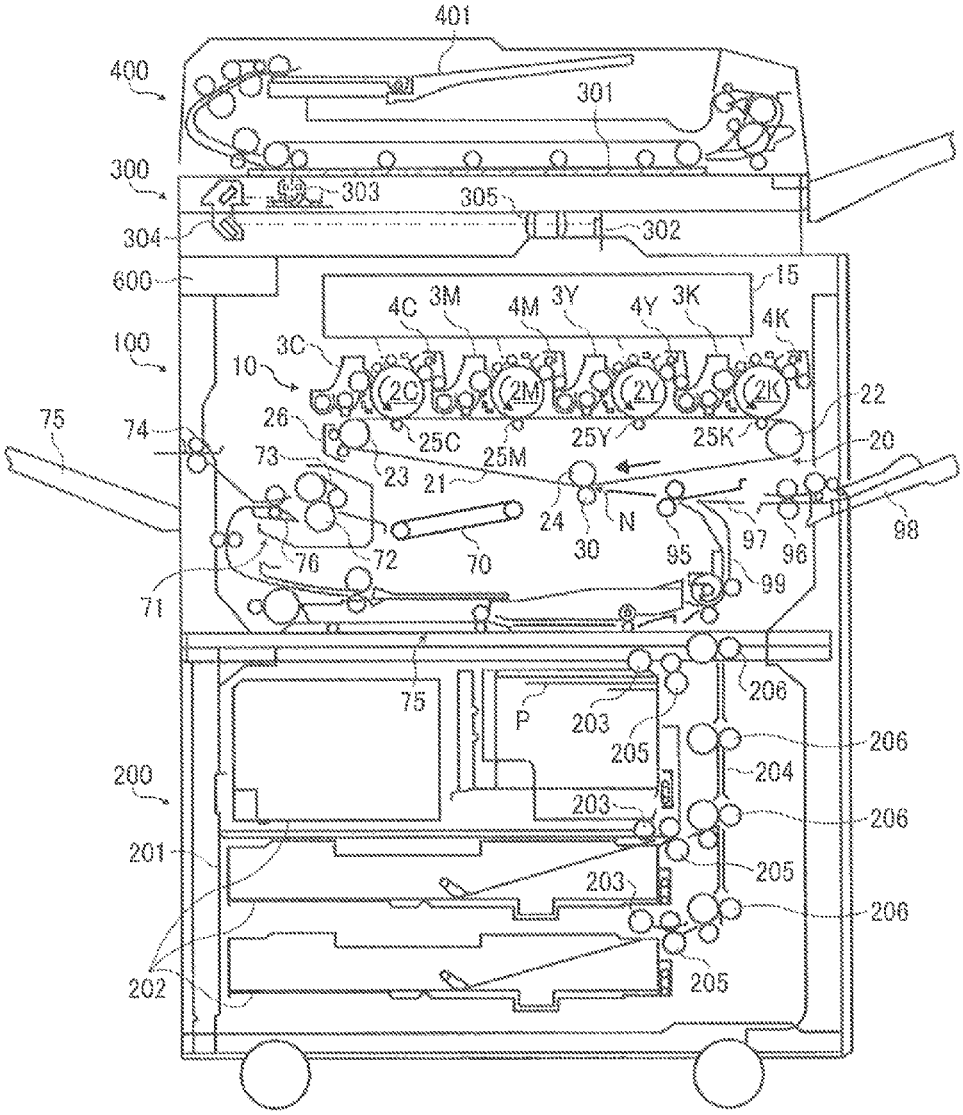
FIG. 1 is a chart illustrating the entire configuration of an exemplary image forming apparatus according to one embodiment of the present invention.

Referring now to the drawings, wherein like reference numerals designate identical or corresponding parts throughout several views, in particular in FIG. 1, an exemplary tandem type color image forming apparatus (hereinafter simply referred to as a copier) is described. The copier includes a printing section 10, a sheet feeding section 200, a scanner section 300 attached above the printing section 100, and an automatic document feeder 400 attached above the scanner section 300. Initially, a configuration and an operation of the entire copier are described, and specific features of this embodiment are then described.

The printing section 100 includes an endless belt type intermediate transfer belt 21 that serves as both an image bearer and an intermediate transfer member. The intermediate transfer belt 21 has a reverse triangle shape when viewed from its side and wound around a driving roller 22 as a rotation member, a driven roller 23, and a secondary transfer opposed roller 24 serving as a supporting member, and is moved clockwise in the drawing by a rotation and driving of the driving roller 22.

The image formation units 1C to 1K include drum state photoconductive members 2C to 2K serving as image bearers, developing units 3C to 3K, and cleaning devices 4C to 4K for photoconductive member use, respectively. The photoconductive members 2C to 2K contact the intermediate transfer belt 21 and are driven and rotated by a driving device, not shown, while creating primary transfer nips for C to K use. The developing units 3C to 3K develop latent images formed on the photoconductive members 2C to 2K with C to K color toner, respectively. The cleaning devices 4C to 4K clean the photoconductive members 2C to 2K passing through the primary transfer nip by removing toner remaining and attracted thereto after transferring. An image formation section 10 is formed in a tandem state in this printer by disposing those side by side in a belt moving direction.

Above the tandem image formation section 10, there is provided an optical writing unit 15 in this printing section 100 to provide an optical writing process to surfaces serving as image bearing surfaces of the photoconductive members 2C to 2K driven and rotated counter clockwise in the drawing to form latent images thereon. Prior to this optical writing process, each of the surfaces of the photoconductive members is uniformly charged by a charger, not shown, provided in each of the image formation units 1C to 1K.

The transfer unit 20 serves as a transfer device and includes an intermediate transfer belt 21 and primary rollers 25C to 25K pressing the intermediate transfer belt 21 toward the photoconductive members 2C to 2K from an inside of the loop thereof.

Below the intermediate transfer belt 21, there is provided a secondary transfer roller 30 opposed to a surface 21*a* as an image bearing surface of the intermediate transfer belt 21 to serve as an opposed member and support the intermediate transfer belt 21 from an inside thereof. The secondary transfer roller 30 contacts, via the intermediate transfer belt 21, a winding section of the transfer opposed roller 24 from the surface 21*a* of the belt and creates a secondary transfer nip N thereon. A recording medium P is conveyed into the secondary transfer nip N at a prescribed time. Toner images of respective four colors are superimposed and transferred onto the belt surface 21*a* at the primary transfer nips, and thus superimposed toner images are then secondary transferred onto the recording medium P at once at the secondary transfer nip N.

The scanner section 300 reads image information on an original document placed on a platen glass 301 with a reading sensor 302 and transmits the image information to a control section of the printing section 100. The controller section 600 controls a laser diode and a light source, such as a LED, etc., provided in the optical writing unit 15 of the scanner section 100 to emit a laser writing light of C to K colors to each of the respective photoconductive members 2C to 2K as an optical scanning process in accordance with the image information. With the optical scanning process, latent images are formed on the surfaces of the respective photoconductive members and are developed as toner images of C to K colors during prescribed developing processes.

The sheet feeding section 200 includes a sheet feed cassette 202 provided in multiple steps in a paper bank 201, a sheet feeding roller 203 that launches a recording medium P from the sheet feed cassette 202, a separation roller 205 that separates the recording mediums P launched thereto and guides those to a sheet path 204, and a conveyance roller 206 that conveys the recording medium P to a sheet path 99 provided in the printing section 100.

A manual recording medium tray 98 is provided to manually feed sheets. A separation roller 98 is also provided to manually feed sheets on the manual recording medium tray 98 to a manual sheet feeding path 97 one by one beside sheet feeding from the sheet feeding section 200. The manual sheet feeding path 97 flows together with the sheet feeding path 99 in the printing section 100.

A pair of registration rollers 95 is provided as a recording medium supply device in the vicinity of the end of the sheet feeding path 99. The pair of registration rollers 95 pinches the recording medium P coming in the sheet feeding path 99 and launches it to a secondary transfer nip N at a prescribed time.

To make a copy of a color image in the copier of this embodiment, an original document is placed onto an original document table 401 provided on the automatic document feeder. Otherwise, the automatic document feeder 400 is open and an original document is placed on a platen glass 301 provided in the scanner section 300. The automatic document feeder 400 is then closed to press the original document. When the original document is placed on the automatic document feeder 400 and a start switch, not shown, is depressed, the original document is conveyed onto the platen glass 301. Subsequently, as the scanner section 300 starts driving, first and second carriages 303 and 304 start running along the surface of the original document. Then, a light emitted from the light source in the first carriage 303 is reflected by the surface of the original document and is further reflected and directed toward the second carriage 304. The reflected light enters a reading sensor 302 passing through an imaging lens 305 after a mirror in the second carriage reflects thereof. Hence, the original document is read.

Upon receiving the image information from the scanner section 300, a recording medium P having a size corresponding to the image information is fed to the sheet feeding path 99 in the printing section 100. Simultaneously, a motor, not shown, drives and rotates the driving roller 22 and moves the intermediate transfer belt 21 counter clockwise in the drawing. At the same time, after start driving and rotating the photoconductive members 2C to 2K in the image formation units 1C to 1K, uniform charging, optical writing, and developing processes are executed thereto. Thus, the toner images of C to K colors on the respective surfaces of the photoconductive member are superimposed one after another at the primary transfer nips for C to K uses and are primarily transferred onto the intermediate transfer belt 21, so that a four color-superimposed toner image is obtained.

In the sheet feeding section 200, one of sheet feeding rollers 203 is selectively rotated in accordance with a size of the recording medium, and thus the recording mediums P are launched from one of three sheet feed cassettes 202. The recording medium P launched is separated one by one by the separation roller 205, and is further launched into the sheet feeding path 206. The recording medium is then conveyed into a sheet feeding path 99 in the printing section 100 via the conveyance roller 206. When the recording medium 98 is used, a sheet feeding roller on the tray is driven and rotated, so that the recording medium on the tray is separated by the separation roller 96 and conveyed into the manual sheet feeding path 97 to reach the vicinity of the end of the sheet feeding path 99. The recording medium P collides with and stops at a pair of registration rollers 95 in the vicinity of the end of the sheet feeding path 99. Subsequently, as the pair of registration rollers 95 rotate at a time capable of synchronizing with the four color superimposed toner images on the intermediate transfer belt 21, the recording medium P is conveyed into a secondary transfer nip N to tightly contact the four color superimposed toner images. Then, under influences of transfer pressure and a secondary transfer bias serving as a transfer electric field or the like, the four color superimposed toner images are secondarily transferred onto the recording medium P.

The recording medium P with the four color superimposed toner images is then conveyed into a fixing device 71 disposed in the printing section 100 by the belt 70, and is pinched in a fixing nip formed therein between a pressing roller 72 and a fixing belt 73. Subsequently, the four color superimposed toner images are fixed onto the surface by pressure and heat. The recording medium P with such a color image formed and fixed in this way is then stacked on a sheet ejection tray 75 disposed outside of the apparatus via a pair of sheet ejection rollers 74.

When an image is also formed on the other surface (i.e., a rear side surface) of the recording medium P, it is conveyed to a recording medium reversing device 75 after being ejected from the fixing device 71 and a switching pick changes a course. Subsequently, when the recording medium P is reversed upside-down, it is returned again to the pair of registration rollers 95, and is passes through the secondary transfer nip N and the fixing device 71 to fix the image. The recording medium P is then stacked on the sheet ejection tray 75.

The cleaning device 26 contacts a belt surface 21*a* of the intermediate transfer belt 21 downstream of the secondary transfer nip N and upstream of the primary transfer nip for C color where an up most primary transfer process is executed among those of processes for four colors to clean thereof by removing toner attracted thereto and remaining thereon after such a transfer process.

Figure 2:
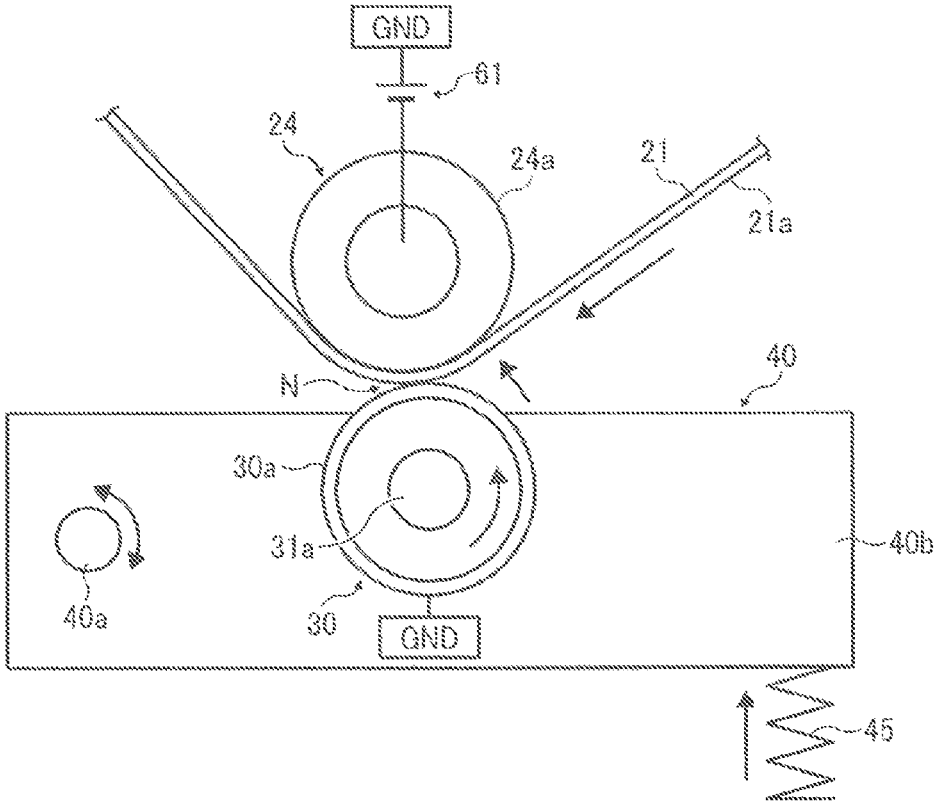
FIG. 2 is an enlarged view illustrating an exemplary secondary transfer nip and surroundings of a transfer device according to one embodiment of the present invention.

An exemplary secondary transfer nip N and surroundings of the transfer unit disposed in the printing section 100 of the copier according to this embodiment is described with reference to FIG. 2. As shown, the secondary transfer opposed roller 24 is disposed inside a loop and is thereby partially wound around by the flexible intermediate transfer belt 21 to support and back it up with its circumference to maintain a shape thereof tracing a prescribed curvature thereof. Accordingly, the secondary transfer opposed roller 24 functions as a backup roller. The secondary transfer roller 30 contacts a belt front surface 21*a* of a winding portion on the intermediate transfer belt 21 winding the secondary transfer opposed roller 24 to form a secondary transfer nip N thereon.

The secondary transfer roller 30 is freely rotatably held on a roller unit holder 40 via a bearing, not shown. The roller unit holder 40 is swingable around a rotation shaft 40*a* to take a posture in parallel to a rotation axis of the secondary transfer roller 30. When the roller unit holder 40 rotates counter clockwise in the drawing around the rotation axis 40*a*, a secondary transfer roller 30 held on the roller unit holder 40 is pressed against the intermediate transfer belt 21 and forms a secondary transfer nip N thereon. Whereas when the roller unit holder 40 rotates clockwise in the drawing around the rotation axis 40*a*, the secondary transfer roller 30 held by the roller unit holder 40 disengages from the intermediate transfer belt 21. In the transfer unit 20, an end 40*b* of the roller unit holder 40 on the opposite side of the rotation shaft 40*a* is always biased toward the intermediate transfer belt 21 by a biasing coil spring 45 as a biasing device. By always applying a force using the biasing coil spring 45 to the roller unit holder 40 to rotate it counter clockwise in the drawing around the rotation axis 40*a*, the secondary transfer roller 30 is biased toward the intermediate transfer belt 21.

When a rotation driving force is transmitted from the roller driving motor via a driving transmission device, such as a gear, etc., not shown, the secondary transfer roller 30 is driven and rotated counter clockwise in the drawing. These roller driving motor and driving transmission device are held by the roller unit holder 40 and enabled to rotate together with the secondary transfer roller 30 and the roller unit holder 40. The roller unit holder 40 may include a secondary transfer cleaning mechanism such as a cleaning blade 39, a solid lubricant 41, a lubricant pressing device 43, etc.

The surface 30*a* of the secondary transfer roller 30, which contacts the belt surface 21*a* of the intermediate transfer belt 21 bearing a toner image serves as a contact surface to attract toner on the belt surface 21*a*. When such attracted toner is left as is, it is transferred onto a rear side of the recording medium P to cause rear side stein. To resolve such a problem, an edge of a cleaning blade 39 contacts the surface 30*a* of the second transfer roller 30 to physically remove the toner therefrom. However, with such a configuration, contact of the cleaning blade 39 causes a load on the secondary transfer roller 30 to impede rotation thereof, so that the secondary transfer roller 30 cannot be driven and rotated by the intermediate transfer belt 21. Therefore, the secondary transfer roller 30 is driven and rotated by the above-described roller driving motor.

A lubricant pressing device 43 presses the solid lubricant 41 composed of zinc stearate lump or the like against the surface 30*a* of the secondary transfer roller 30 with the bias coil spring 42 and thereby coating the surface with the lubricant powder. Consequently, a rotational load and winding up of an edge of the blade, generally caused by the contact between the cleaning blade 39 and the surface 30*a* of the secondary transfer roller 30, can be suppressed. Instead of pressing the solid lubricant 41 against the surface 30*a* of the secondary transfer roller 30, a rotation coating brush can be employed to scrape the solid lubricant 41 and at same time coats it to the surface 30*a* of the secondary transfer roller 30.

Now, an exemplary distinguishing configuration of the transfer unit 20 and copier is described. When a leading end of a recording medium plunges into or just when the trailing end thereof exits from the secondary transfer nip N formed between the belt surface 21*a* of the intermediate transfer belt 21 and the surface 30*a* of the secondary transfer roller 30, impact conventionally is applied to the intermediate transfer belt 21 and changes a velocity of the intermediate transfer belt 21. Consequently, an image forming apparatus is recently demanded to especially increase usability to accommodate various sheet types of recording mediums P. As a result, when a cardboard having a basic weight of about 300 g/m$^2$ is used as a recording medium P, the impact increases and causes impact jitter as a serious problem.

As a device to resolve such a problem, a first embodiment is described with reference to FIG. 3, wherein an enlarged cross sectional view of surroundings of a secondary transfer nip N of the transfer unit 20 is described.

As shown, the secondary transfer roller 30 includes a roller section 31 extending in a widthwise direction perpendicular to that of a recording medium member conveyance, a pair of first and second shaft members 32 and 33 protruding from both ends and extending in a rotation shaft direction, and first and second idling rollers 34 and 35. The roller section 31 includes a hollow cylindrical metal core 31*a*, an elastic layer 31*b* overlying the circumference of the metal core 31*a*, and a surface layer 31*c* overlying the circumference of the elastic layer 31*b*.

Material of the metal core 31*a* includes stainless, aluminum, and the like, but is not limited thereto. The elastic layer 31*b* preferably has a prescribed JIS-A hardness equal to or less than about 70 degree. However, since the cleaning blade 39 contacts the roller section 31, various problems can be induced if the elastic layer 31*b* is too soft. Consequently, the JIS-A hardness of the elastic layer 31*b* is preferably equal to or less than about 40 degree. Otherwise, the elastic layer 31*b* can have a JIS-A hardness of about 50 degree and is made of epichlorohydrin rubber having a certain amount of conductivity. Instead of the epichlorohydrin rubber, EPDM and Si rubber with dispersion of carbon, NBR having an ion conducting function, and urethane rubber or the like can be employed to have conductivity. Since many rubbers have a preferable chemical affinity for toner and a relatively large friction coefficient, the surface of the elastic layer 31*b* is covered with a surface layer 31*c*. Consequently, an amount of toner attracted to the surface of the roller section 31 and a sliding load on the cleaning blade 39 are decreased. As material of the surface layer 31*c*, fluorine resin having a preferable toner releasing performance at a low friction coefficient is preferably used by including resistance adjuster, such as carbon, ion conductive agent, etc.

A line speed of the secondary transfer roller 30 is sometimes slightly different from that of the belt surface 21*a* when rotating while contacting the belt surface 21*a*. To avoid slipping of the belt caused by the slight difference in line speed, a friction coefficient of the surface layer 31*c* is adjusted to be equal or less than 0.3. Because, since the intermediate transfer belt 21 is expected to move at a constant speed to transfer and superimpose respective color images without deviation therebetween, desecrating in the surface friction resistance of the surface layer 31*c* is important. The secondary transfer roller 30 with the above-described configuration is biased by the bias coil spring 45 toward the intermediate transfer belt 21 wound around the secondary transfer opposed roller 24 as shown in FIG. 2.

The secondary transfer opposed roller 24 includes a roller section 24*b* composed of a cylindrical column body, and a penetration shaft member 24*a* that penetrates through a rotation center in its rotational axis direction to allow the roller section 24*b* to execute idling rotation therearound. The penetration shaft member 24*a* is made of metal and freely rotatably supports the roller section 24*b* on its circumference to allow it to execute idling rotation. The roller section 24*b* serving as a body section includes a drum state hollow metal core 24*c*, an elastic layer 24*d* made of elastic member firmly disposed on a circumference of the hollow metal core 24*c*, a pair of ball bearings 24*e* inserted with pressure into both ends of the hollow metal core 24*c* in the axial direction. Thus, the ball bearing 24*e* rotates on the penetration shaft member 24*a* together with the hollow metal core 24*c* while supporting thereof. An elastic layer 24*d* is inserted with pressure into an outer circumferential surface of the hollow metal core 24*c*.

The penetration shaft member 24*a* is freely rotatably supported by first and second bearings 52 and 53 firmly disposed on first and second side plates 28 and 29 of the transfer unit 20 that stretches the intermediate transfer belt 21, respectively. However, the penetration shaft member 24*a* stops almost all the time during a printing job without being driven and rotated, and allows the roller section 24*b* tending to be driven as the intermediate transfer belt 21 endlessly moves to freely execute idling rotation on its circumference.

The elastic layer 24*d* firmly disposed on the circumference of the hollow metal core 24*c* is made of conductive rubber with its resistance being adjusted by adding conductive agent thereto to have a resistance equal to or more than 7.5 Log Ω (Ohm). An electric resistance of the elastic layer 24*d* is adjusted in a prescribed range as described earlier to avoid concentration of transfer current at a section where the belt surface 21*a* directly contacts the roller surface in the secondary transfer nip N when a recording medium having a relatively small size in the roller shaft direction, such as A5 size (JIS), etc., is used. Such concentration of the transfer current can be suppressed by increasing an electric resistance of the elastic layer 24*d* to be greater than that of the recording medium P.

Foam rubber having an Asker-C hardness of about 40 degree can be used as the conductive rubber material of the elastic layer 24*d*. Using such elastic layer 24*d* made of the foam rubber, a thickness of the elastic layer 24*d* is flexibly changed in the thickness direction in the secondary transfer nip N, so that the secondary transfer nip N can have a wide range in the recording medium conveyance direction to the some extent. The elastic layer 24*d* is a drum state having a larger outer diameter at its center than that of the side ends. As a result, the secondary transfer opposed roller 24 is a drum state having smaller outer diameter at its both ends 24B and 24C than that at the center 24A thereof. By employing such a drum shaped roller, neither bending occurs nor pressure is lost due to the bending when the secondary transfer roller 30 is biased toward the intermediate transfer belt 21 and forms the second transfer nip N thereon.

Further, as described with reference to FIG. 2, for the convenience of engaging the cleaning blade 39 with the secondary transfer roller 30, elasticity enriched material is rarely employed in the roller section of the secondary transfer roller 30. Consequently, instead of the secondary transfer roller 30, the roller section 24*b* of the secondary transfer opposed roller 24 is enabled to elastically deform.

The penetration shaft member 24*a* of the secondary transfer opposed roller 24 includes striking members striking with the secondary transfer roller 30 at both ends thereof in the lengthwise direction deviated from the roller section 24*b*. Specifically, a pair of cams 50 and 51 is secured to the both ends of the penetration shaft member 24*a* to integrally rotate with the penetration shaft member 24*a* as a part of an engaging and disengaging device. Specifically, the first cam 50 is secured to one of the ends in the lengthwise direction of the penetration shaft member 24*a*. The cam 50 includes a cam section 50A and a perfect circular roller section 50B integrated in the shaft direction side by side. The cam 50 is secured to the penetration shaft member 24*a* by screwing a screw 80 penetrated into the roller section 50B into the penetration shaft member 24*a*. The cam 51 similarly includes a cam section 50A and a perfect circular roller section 50B integrated in the shaft direction side by side, and is secured to the other side end region of the penetration shaft member 24*a* in the lengthwise direction thereof with the same configuration as the cam 50. A driving reception pulley 54 is secured to a region of the penetration shaft member 24*a* outside the cam 51 in the shaft direction. A detection target disc 59 is secured to a yet outside of the driving reception pulley 54.

A cam driving motor 58 for driving and rotating the cams 50 and 51 both in normal and reverse rotation directions is disposed on the second side plate of the transfer unit 20. The cam driving motor 58 rotates a motor pulley 57 disposed on its output shaft and transmits a driving force to the driving reception pulley 54 secured to the penetration shaft member 24*a* via a timing belt 56. With such a configuration, when the cam driving motor 58 operates, the penetration shaft member 24*a* can be rotated. Even when the penetration shaft member 24*a* is rotated, the roller section 24*b* can be driven by the intermediate transfer belt 21 without being disturbed, because the roller section 24*b* can freely execute idling rotation on the penetration shaft member 24*a*. Further, as the cam driving motor 58, a stepping motor or the like is used to freely designate a motor rotation angle omitting a rotation angle detection device, such as an encoder, etc. Of course, the rotation angle detection device can be employed to detect a rotation angle of the cam driving motor.

Outer circumferential surfaces 50C and 51C of the cams 50 and 51 are formed, so that cam sections 50A and 51A bump into and push the secondary transfer roller 30 back against a bias force of the bias coil spring 45 of the roller unit holder 40 when the penetration shaft member 24*a* rotates and stops at a prescribed rotation angle. Specifically, by adjusting rotation positions of the cams 50 and 51 and thereby moving the secondary transfer roller 30 in the vicinity of the secondary opposed roller 24 (ultimately to the intermediate transfer belt 21), a shaft interval L between the secondary transfer roller 30 and the secondary opposed roller 24 is adjusted. Further, when the shaft interval L is adjusted, a gap X between the surface 30*a* of the secondary transfer roller 30 and that 21*a* of the secondary transfer belt 21 can be adjusted.

In this embodiment, the shaft interval L between the secondary transfer roller 30 and the secondary opposed roller 24 is adjusted at least by the cams 50 and 51 as well as the cam driving motor 58. Specifically, an engaging and disengaging device 500 for engaging and disengaging the surface 21*a* of the intermediate transfer belt from the surface of the secondary transfer roller 30 is provided. The secondary transfer opposed roller 24 serves as a freely rotatable support member and allows the cylindrical column state roller section 24*b* to freely execute idling rotation on the penetration shaft member 24*a* penetrated therethrough. Since the cams 50 and 51 secured to the both ends of the penetration shaft member 24*a* in the axial direction thereof integrally rotate when the penetration shaft member 24*a* rotates, the cams 50 and 51 on the both ends can be rotated with a driving transmission mechanism only on one end thereof in the axial direction.

The hollow metal core 31*a* of the secondary transfer roller 30 is grounded and a secondary transfer bias having the same polarity as toner is applied to the hollow metal core 24*c* of the secondary transfer opposed roller 24 in this copier. Thus, a second transfer electric field is created between these rollers in the secondary transfer nip N to electrostatically move toner from the secondary transfer opposed roller 24 to the secondary transfer roller 30. Specifically, the first bearing 52 freely supporting the penetration shaft member 24*a*, which is made of metal and included in the secondary transfer opposed roller 24, includes a conductive sliding bearing. A high voltage power source 61 is connected to the first bearing 52 to output a secondary transfer bias as a transfer device. The secondary transfer bias outputted from the high voltage power source 61 is supplied to the secondary transfer opposed roller 24 via the first conductive bearing 52. Then, the secondary transfer bias travels the penetration shaft member 24*a* made of metal, a ball bearing 24*e* made of metal, a hollow metal core 24*c*, and a conductive layer 24*d* made of metal in this order in the secondary transfer opposed roller 24.

The detection target disc 59 secured to one end of the penetration shaft member 24*a* includes a detection target section 59*a* rising in an axial direction at a prescribed position in the rotational direction of the penetration shaft member 24*a*. Further, an optical sensor 60 serving as a detection device is secured to a sensor bracket 501 secured to the second side plate 29 of the transfer unit 20. When the penetration shaft member 24*a* rotates and positions within a prescribed rotation angular range, the detection target section 59*a* of the detection target disc 59 enters between the light emitting and receiving elements and cuts off an optical path therebetween during rotation thereof. The light reception element of the optical sensor 60 transmits a light reception signal to a controller 600 upon receiving the light from the light emitting element.

The controller 600 includes a known computer and is connected to the optical sensor 60 and the cam driving motor 58. The controller 600 calculates a time when a reception signal from the light reception element of the optical sensor disappears or a driving amount of the cam driving motor 58 based on the time, and activates the cam driving motor 58. The controller 600 further detects rotation angles of the cams 50 and 51 secured to the penetration shaft member 24*a* and stops them at prescribed positions as described later with reference to FIG. 4 and subsequent drawings.

These cams 50 and 51 bump into the secondary transfer roller 30 at a prescribed rotation angle and push it back against the bias of the bias coil spring 45 away from the secondary transfer opposed roller 24 (hereinafter referred to as depression). At that moment, an amount of pushing back (hereinafter referred to as depression) is determined based on the rotation angles (i.e., positions) of the cams 50 and 51. Specifically, the larger the pushing down amount of the secondary transfer roller 30 by these cams 50 and 51, the larger the shaft interval L between the secondary transfer roller 30 and secondary transfer opposed roller 24.

A first idling roller 34 is capable of freely executing idling rotation and is disposed on the first shaft member 32 that integrally rotates with the roller section 31. The first idling roller 34 has a doughnut disc shape having a slightly larger outer diameter than that of the roller section 31, and function as a ball bearing by itself, and is capable of executing idling rotation on the circumferential surface of the first shaft member 32. A second idling roller 35 with the same configuration as the first idling roller 34 is disposed on the second shaft member 33 of the secondary transfer roller 30.

The cams 50 and 51 secured to the penetration shaft member 24*a* include prescribed outer circumferential surfaces 50C and 51C enabling to strike the idling rollers 34 and 35 at prescribed rotation angle positions in the secondary transfer opposed roller 24. Specifically, a cam section 50A of the first cam 50 secured to one end of the penetration shaft member 24*a* strikes the first idling roller 34 of the secondary transfer roller 24. At that moment, a cam section 51A of the second cam 51 secured to the other end of the penetration shaft member 24*a* strikes the second idling roller 35 of the secondary transfer roller 24. The idling rollers 34 and 35 plunged into by the cams 50 and 51 are interrupted to rotate accordingly. However, rotation of the secondary transfer roller 30 is not interrupted. Because, the idling rollers 34 and 35 have the bearings 32 and 33, and thus the shaft members 32 and 33 of the secondary transfer roller 30 can freely rotate independently from the idling rollers 34 and 35 even when the idling rollers 34 and 35 stop rotating. Further, by stopping rotation of the idling rollers 34 and 35 as the cam sections 50A and 51A plunges thereinto, a friction and accordingly a torque of driving motors driving the belt and the secondary transfer roller 30 increased due to the friction can be suppressed.

Now, exemplary features and operations of the cams 50 and 51 are described with reference to FIGS. 4 to 11. As shown, the cams 50 and 51 each include a prescribed shape providing two different displacements, so that four different cam positions A to D can be designated.

The cam positions A and C correspond to the outer diameters of the cam. The cam positions B has a deviation amount δ (Delta)=1 mm (i.e., 1 mm greater than the cam positions A and C), whereas the cam positions D has a deviation amount (Delta)=0.7 mm (i.e., 0.7 mm greater than the cam positions A and C).

Thus, when the cam positions B and D contact the idling rollers 34 and 35 on the secondary transfer roller shaft, the secondary transfer roller is pushed down (depressed), so that a surface distance between the surface 24*a* of the secondary transfer roller 254 and that 30*a* of the secondary transfer opposed roller 24 can be changed. An outer diameter of the cam is determined not to depress the secondary transfer roller at the cam positions A and C. Specifically, the cams 50A and 51A include cam portions 50*a* and 51*a* and 50*b* and 51*b* at the cam positions B and D, respectively.

Figure 5:
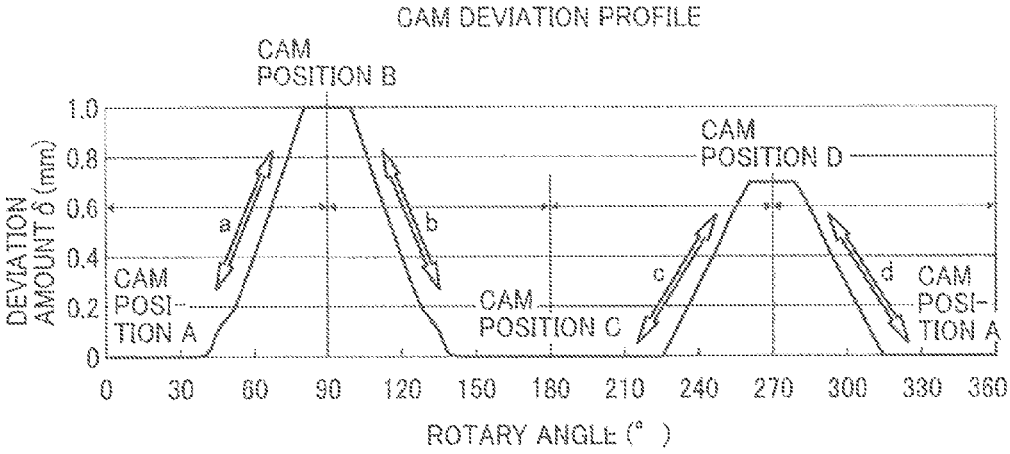
FIG. 5 is an exemplary profile showing a change in diameter of a cam.

As shown in FIG. 5, deviation profiles of the cams 50 and 51 are each symmetrical. Specifically, by equalizing the deviation profile formed from the cam position A center to the cam position B center with that formed from the cam position B center to the cam position C center, the same deviation can be obtained regardless of the rotational direction of the cams 50 and 51 from the cam position B center. Similarly, the deviation profile formed from the cam position C center to the cam position D center with that formed from the cam position D center to the cam position A center is equalized.

Figure 6:
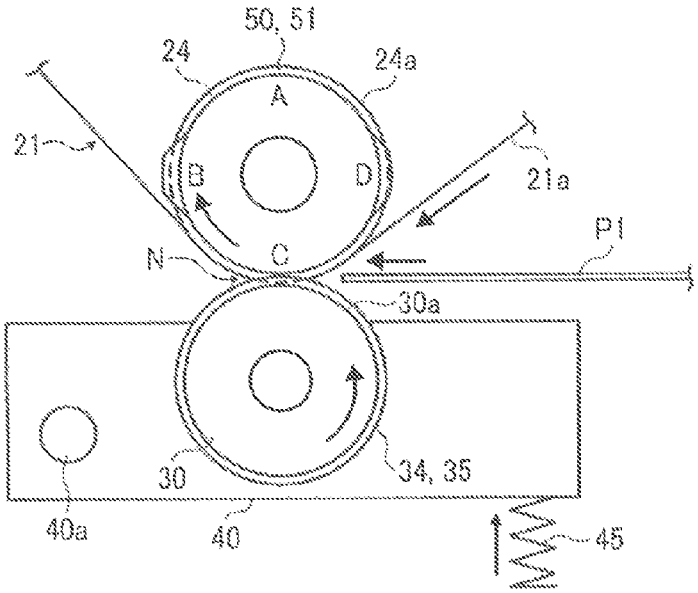
FIG. 6 is an enlarged view illustrating an exemplary condition of the secondary transfer nip right before a recording medium enters thereto in the transfer device.

As shown in FIG. 6, when a plain paper P1 enters a secondary transfer nip N, a cam driving motor 58 is controlled by the controller 600 to stop the penetration shaft member 24*a* of the secondary transfer opposed roller 24 at a prescribed position where the cams 50 and 51 of the secondary transfer opposed roller 24 do not strike the idling rollers 34 and 35 of the secondary transfer roller 30 (i.e., a position where the cam position C is directed downward). Specifically, when the plain paper is used, the cams 50 and 51 do not execute depression of the secondary transfer roller 30. That is, when a relatively thin plain paper P1 enters the secondary transfer nip N, a large load is not generated on the intermediate transfer belt 21 and the secondary transfer roller 30 even if the secondary transfer roller 30 is not depressed.

Figure 7:
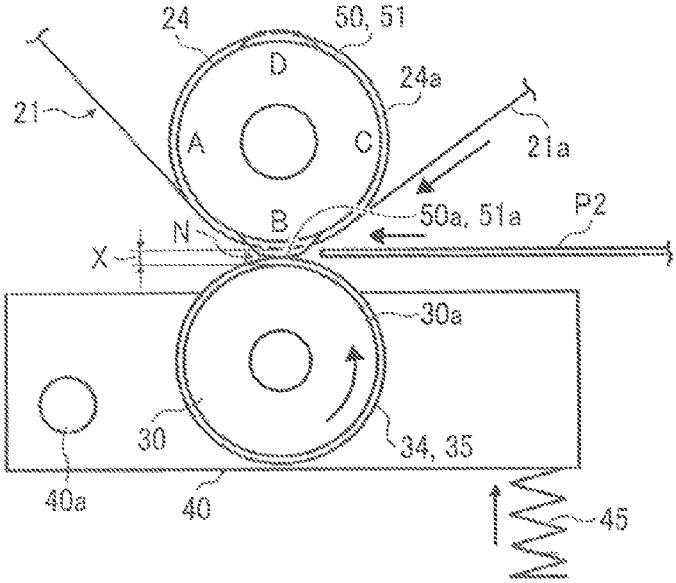
FIG. 7 is an enlarged view illustrating an exemplary condition of the secondary transfer nip right before a cardboard enters thereto in the transfer device.

When a cardboard P2 enters the secondary transfer nip N, the controller 600 controls the cam driving motor 58 to stop rotation of the penetration shaft member 24*a* of the secondary transfer opposed roller 24 at a position where the cams 50 and 51 of the secondary transfer opposed roller 24 strike the idling rollers 34 and 35 (i.e., the cam position B) as shown in FIG. 7. Specifically, when the cardboard P2 is used, the depression of the secondary transfer roller 30 by the cams 50 and 51 is executed to obtain the surface gap X between the surfaces 30*a* and 21*a* of the secondary transfer roller 30 and the intermediate transfer belt 21, respectively.

With such control, even the thick cardboard P2 enters the secondary transfer nip N, a load hardly changes and impact jitter rarely occurs on the intermediate transfer belt 21 and the secondary transfer roller 30.

Figure 8:
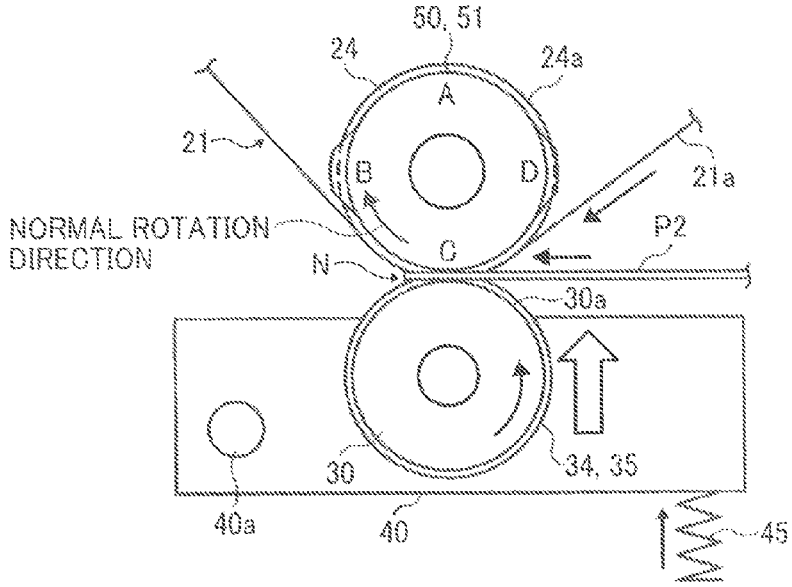
FIG. 8 is an enlarged view illustrating an exemplary condition of the secondary transfer nip right after the cardboard enters thereto in the transfer device.

However, a sufficient nip pressure cannot be obtained for transferring, thereby decreasing a transfer performance of a toner image. Especially, when a recording medium having poor surface smoothness is used, a transfer ratio significantly deteriorates. Accordingly, the controller 600 controls the cam driving motor 58 to rotate the cams 50 and 51 clockwise and stops it at a position where the cam position C is directed downward to rotate the penetration shaft member 24*a* of the secondary transfer opposed roller 24, so that the cams 50 and 51 of the secondary transfer opposed roller 24 come to positions where the cams 50 and 51 do not strike the idling rollers 34 and 35 of the secondary transfer roller 30 right after the recording medium enters the secondary transfer nip N as shown in FIG. 8. Such rotation needs to start driving after the recording medium enters the secondary transfer nip N and is completed before a toner image comes thereto.

Figure 9:
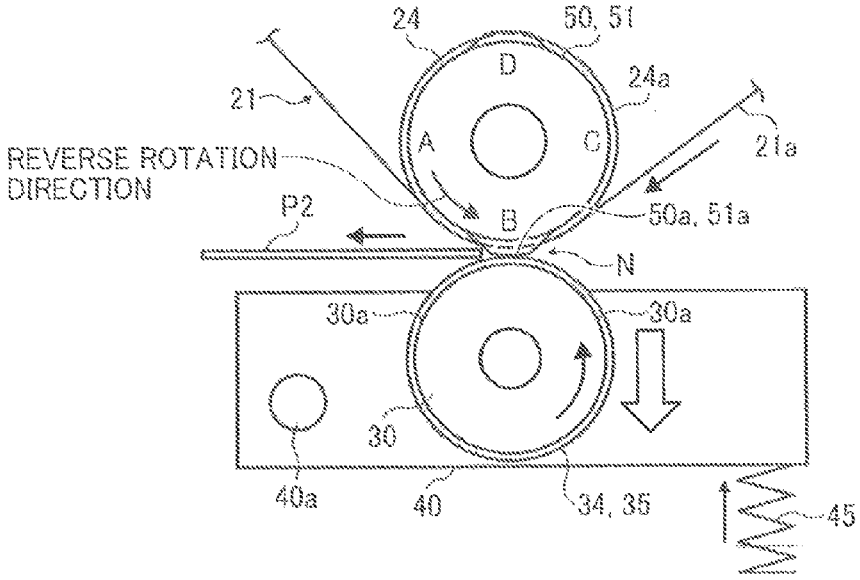
FIG. 9 is an enlarged view illustrating an exemplary condition of the secondary transfer nip right after the cardboard exits thereof in the transfer device.

During an image transfer process, the cams 50 and 51 of the secondary transfer opposed roller 24 are kept out of positions where the cams 50 and 51 do not strike the idling rollers 34 and 35 (i.e., a position where the cam position C is directed downward). Specifically, the cam driving motor 8 stops driving at the time. As shown in FIG. 9, the controller 600 controls the driving motor 58 to rotate the cams 50 and 51 of the secondary transfer opposed roller 24 in an opposite direction (e.g. counter clockwise) from when an image on the belt surface 21*a* of the intermediate transfer belt 21 is transferred to when a trailing end of the recording medium (e.g. a cardboard P2) exits from the secondary transfer nip N. The controller 600 then stops the driving motor 58 to located the cams 50 and 51 at a position (i.e., a cam position B) to strike the idling rollers 34 and 35 of the secondary transfer roller 30.

That is, since the thick cardboard P2 also causes a significant change in load on the intermediate transfer belt 21 and the secondary transfer roller 30 when quitting from the secondary transfer nip N, the secondary transfer roller 30 is similarly depressed as executed when entering thereto to avoid the problem.

Subsequently, the cam driving motor 58 and accordingly the cam are stopped so that the cam position B is directed downward and the secondary transfer roller 30 is depressed until a leading end of the next recording medium enters the secondary transfer nip N. As a result, the change in load on the intermediate transfer belt 21 and the second (subsequent) transfer roller 30 caused when the second sheet of the recording medium enters the secondary transfer nip N can be suppressed as obtained in the first (precedent) sheet thereof.

After entrance of the leading end of the second sheet into the nip, the controller 600 controls the cam driving motor 58 to rotate the cams 50 and 51 in an opposite direction (i.e., counter clockwise) to that the leading end of the first sheet enters. Specifically, the cams 50 and 51 of the secondary transfer opposed roller 24 is rotated to a position do not strike the idling rollers 34 ad 35 of the secondary transfer roller 30 (i.e., a position where the cam position A is directed downward).

Figure 4:
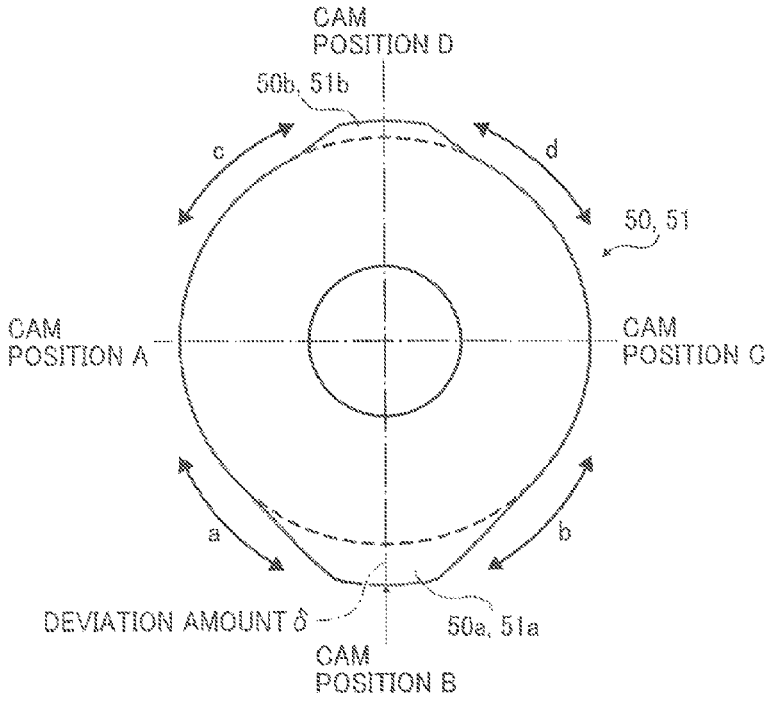
FIG. 4 is an enlarged view illustrating an exemplary shape of an outer diameter of a cam disposed in a secondary transfer opposed roller.

Thus, as shown in FIGS. 4 and 5, by changing the movement position of the cams 50 and 51 in the first and second sheet passages, durability against abrasion of the cam surface and driving section of the cams 50 and 51 can be improved.

That is, when the deviation profiles are not symmetric, e.g. "a" and "b" or "c" and "d" in FIG. 4, normal and reverse rotations are repeatedly used with one of inclinations of "a" and "b", or "c" and "d", so that their lives are almost halved. Further, depending on a basic weight of the recording medium, a significant change sometimes occurs in belt speed when a few moments has elapsed after a leading end of a sheet plunges into the nip. For example, when a recording medium having a basic weight of 300 g/m$^2$ passes through the secondary transfer nip N when the cams 50 and 51 stop at the cam position B with a deviation amount of 1 mm, a change does not occur in speed of the intermediate transfer belt 21 from when it enters to when it exits. By contrast, when a recording medium having a basic weight of 160 g/m$^2$ passes through the secondary transfer nip N when the cams 50 and 51 stop at the cam position B (with a deviation amount of 1 mm), the change occurs in speed of the intermediate transfer belt 21. That is, when the cams 50 and 51 that depresses the secondary transfer roller 30 rotate and the depression of the secondary transfer roller 30 is thereby released, vibration caused by contact between the secondary transfer roller 30 and the secondary transfer opposed roller 24 via the intermediate transfer belt 21 induces a change in speed of the intermediate transfer belt 21.

Then, the cam position is change to the position D having an amount of deviation of 0.7 mm to decrease a depression amount of the secondary transfer roller 30 and suppress the vibration caused when the depression is released. However, since the depression amount is small when the basic weight of the recording medium is about 300 g/mm$^2$ as different from when it is 160 gmm$^2$, a change in speed occurred in the intermediate transfer belt 21 falls within an allowable range when entering the nip P, but an image is disturbed.

Figure 3:
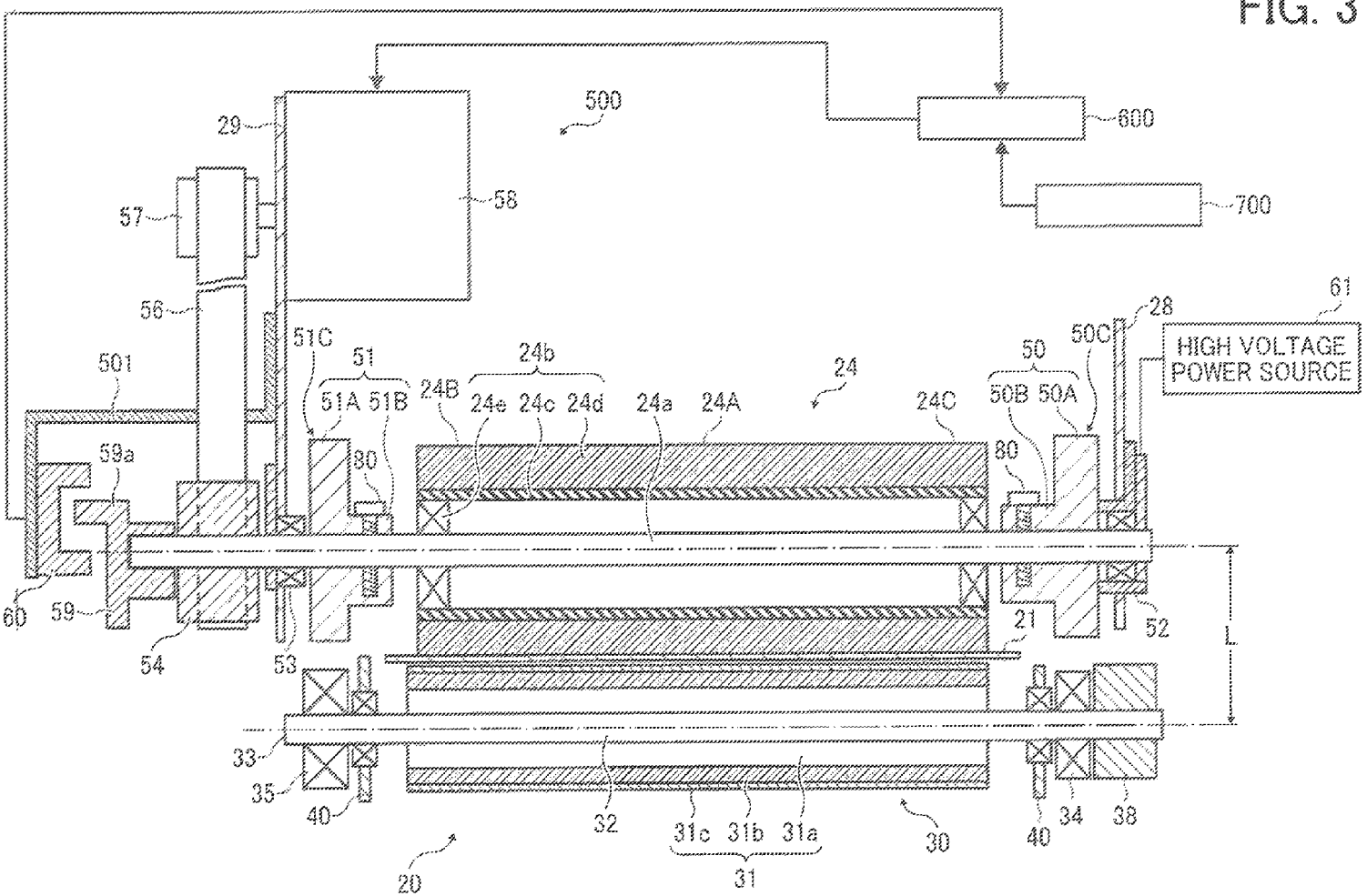
FIG. 3 is an enlarged cross sectional view illustrating the surroundings of the exemplary secondary transfer nip.

Thus, since a depression amount is preferably changed in accordance with a thickness of the recording medium, a thickness information acquiring device 700 is disposed in the copier to acquire thickness information of the recording medium conveyed to the secondary transfer nip N as shown in FIG. 3. As a thickness acquiring device 700, a thickness detection sensor is employed to practically detect a thickness of a sheet conveyed on a sheet passage 99. Otherwise, a data input device may be employed to receive data related to thickness inputted by an operator. As a thickness sensor, an optical sensor that detects a light transmission ratio in a thickness direction or a sensor that detects an amount of displacement of rollers when a sheet is pinched therebetween can be employed.

The controller 600 is enabled to adjust a depression amount of the secondary transfer roller 30 in accordance with a result of acquisition by the thickness information acquiring device 700. Specifically, a data table representing a relation between thickness information and a corresponding rotation stop position of the penetration shaft member 24*a* (i.e., an amount of depression) is stored in data storage, such as a ROM, etc., in the controller 600. Then, a corresponding rotation stop position of the penetration shaft member 24*a* to the thickness of the recording medium is specified from the data table, and the cam driving motor 58 is operated to rotate the penetration shaft member 24*a* to the rotation stop position as specified. Further, the controller is enabled to start entrance of the recording medium into the secondary transfer nip N after determining stopping positions of the multi step cams 50 and 51. By suitably designating a secondary transfer depression amount for the thickness of the recording medium with the above-described device, impacts generally generated when the recording medium enters or depression is released can be suppressed.

The controller 600 recognizes a rotation stop position of the penetration shaft member 24*a* based on a time when the optical sensor 60 detects a detection target section 59*a* of the detection target disc 59 or a driving amount of a stepping motor serving as a cam driving motor 58 after the time.

Hence, a situation where the cams 50 and 51 are disposed on the side of the secondary transfer opposed roller 24 to adjust a surface distance (i.e., a gap X) between the belt surface of the intermediate transfer belt 21 wound around the secondary transfer opposed roller 24 and the secondary transfer roller 30 is described heretofore. However, such a gap X can be adjusted by another system. For example, a depressing member is disposed on the roller unit holder 40 so that the cams 50 and 51 adjust the surface distance (i.e., the gap X) between the belt surface 21*a* and the secondary transfer roller 30.

Now, an exemplary relation among a recording medium, a cam position, and a pattern for adjustment is described. The pattern is formed to adjust density and positional deviation, and to avoid twisting of a blade or the similar and any other purposes as far as it is formed as an image corresponding to an interval between sheets.

Figure 10A:
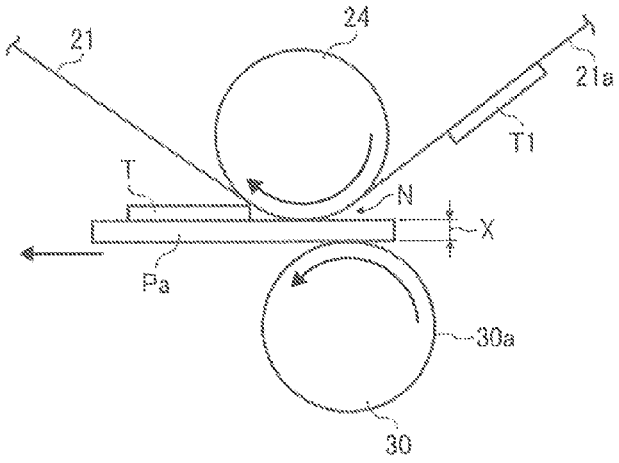
FIG. 10A illustrates an exemplary condition of the secondary transfer nip when an image formed on an intermediate transfer member is transferred onto a previous recording medium.
Figure 10B:
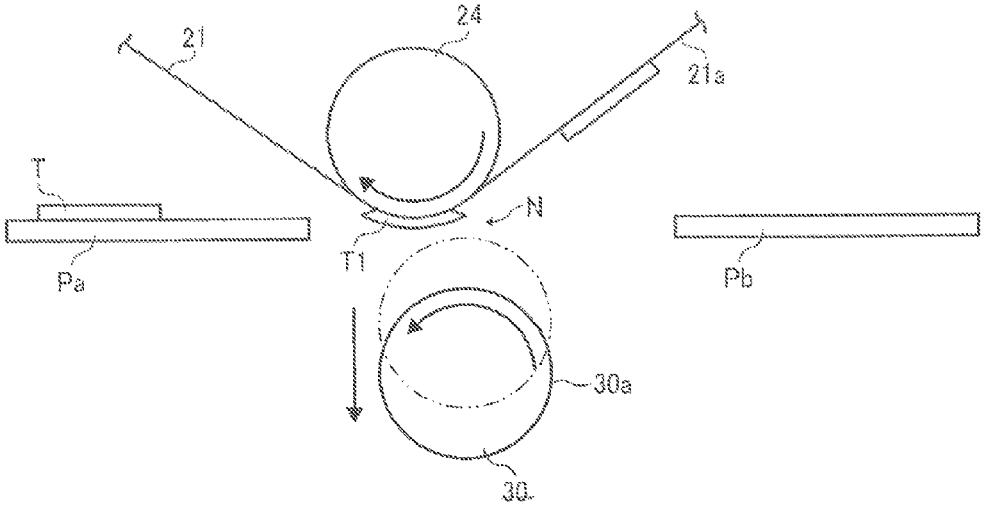
FIG. 10B illustrates an exemplary condition of the secondary transfer nip when a leading end of the next recording medium enters thereto after an adjustment pattern passes therethrough.

FIGS. 10A and 10B typically collectively illustrate an exemplary second transfer position in an interval between sheets and an image position on an intermediate transfer belt 21 when multiple recording mediums successively pass therethrough. In particular, FIG. 10A illustrates an exemplary condition when an image T formed on an intermediate transfer belt 21 is transferred onto a previous recording medium Pa at a secondary transfer nip. At that moment, before the next image arrives, that is, the adjustment pattern T1 is formed on the belt surface 21*a* of the intermediate transfer belt 21 corresponding to an interval between sheets. Subsequently, when a recording medium currently subjected to a transfer process is ejected, the above-described cams 50 and 51 rotate and the surface distance between the secondary transfer roller 30 and the belt surface 21*a* is broadened. FIG. 10B illustrates an exemplary condition when a leading end of the next recording medium enters the secondary transfer nip when an adjustment pattern has passed therethrough.

Figure 11:
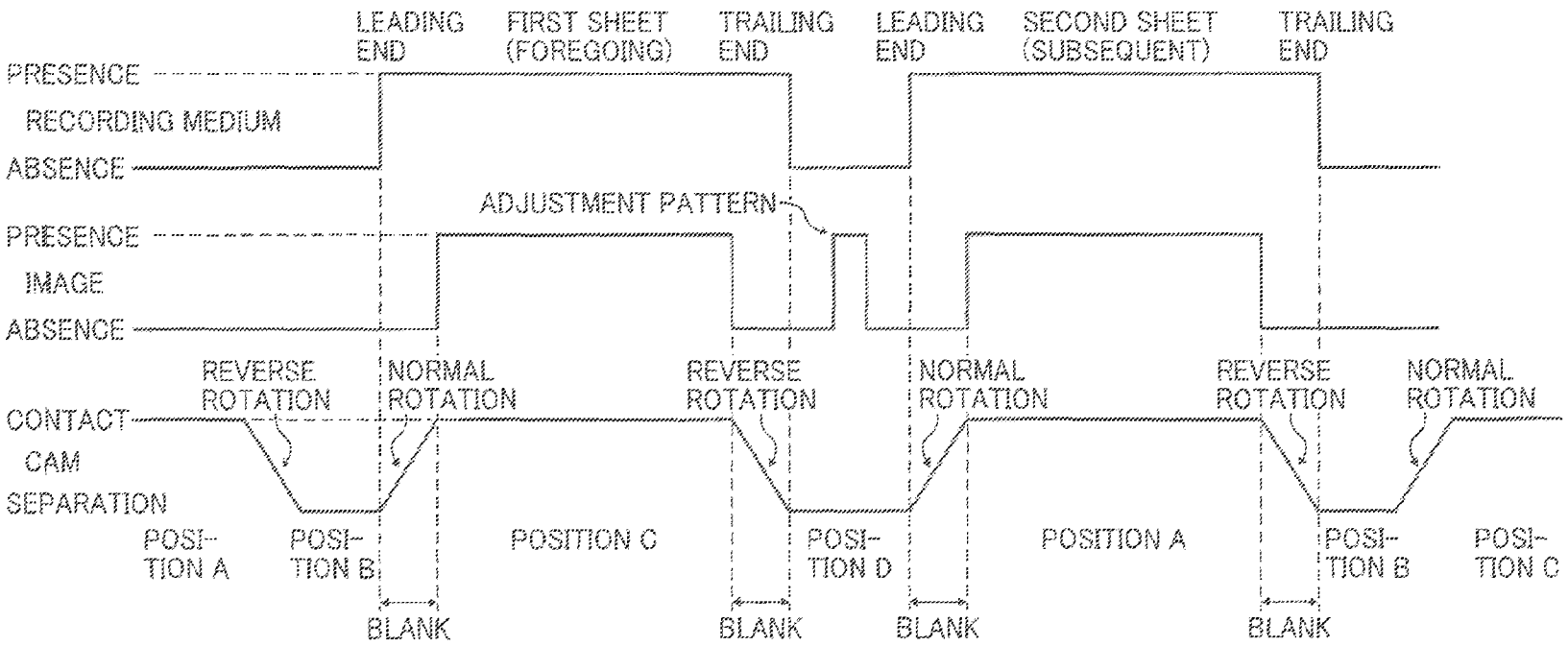
FIG. 11 is a time chart illustrating an exemplary sequence of a sheet, an adjustment pattern, and a position of a cam according to a first embodiment of the present invention.

Then, as shown in FIG. 10B, when a leading end of the subsequent recording medium Pb enters the secondary transfer nip N after the adjustment pattern T1 has passed, the cams 50 and 51 are rotated again to contact the first and second idling rollers 34 and 35. A sequence of the recording medium Pb having a basic weight of 300 g/mm$^2$, an image, and a cam position at that time is illustrated in FIG. 11.

The controller 600 controls an operation of the cam driving motor 58 and accordingly rotation of the penetration shaft member 24*a* to provide the cam position D where a deviation amount δ (delta) is small (e.g. 0.7 mm) when an adjustment pattern T1 is formed corresponding to an interval between sheets. Specifically, the cams 50 and 51 are initially located at a position A, so that the secondary transfer roller 30 and the belt surface 21*a* of the intermediate transfer belt 21 contact each other as shown in FIG. 11. Then, the cams 50 and 51 rotate and are located at the position B, serving as a separation position for a recording medium having 300 gmm$^2$, and disengages the secondary transfer roller 30 from the belt surface 21*a* of the intermediate transfer belt 21 before the recording medium enters therebetween. Subsequently, the cams 50 and 51 rotate again and are located at the position C to engage the secondary transfer roller 30 with the belt surface 21*a* when the next recording medium has entered, thereby transferring an image onto a recording medium. Then, the cams 50 and 51 rotate before ejection of the sheet, so that the secondary transfer roller 30 is disengaged from the transfer belt surface 21*a*. At that time, the cams 50 and 51 generally are located at the position B. However, since the adjustment pattern is formed corresponding to the interval between the sheets, the cams 50 and 51 are located at the position D having smaller deviation amount δ (delta) and make the above-described separation. After passage of the adjustment pattern through the secondary transfer nip N under separation condition and before entrance of a leading end of the next recording medium, the cams 50 and 51 rotate and are located at the position A and make the above-described contact, thereby transferring the image onto the recording medium. Specifically, the cams 50 and 51 are driven by the cam driving motor 58 controlled by the controller 600 to rotate and change four positions from A to D in this order.

With such a configuration, since toner is not transferred onto the secondary transfer member (i.e., an intermediate transfer belt 21) in an interval between sheets, a secondary transfer cleaning mechanism can be omitted, thereby downsizing an apparatus. Further, by using the engaging and disengaging device 500 as a pushing down mechanism, a change in speed can be suppressed when a leading end of a sheet enters and a trailing end thereof exits therefrom. As a result, a poor image is not generated.

Figure 12:
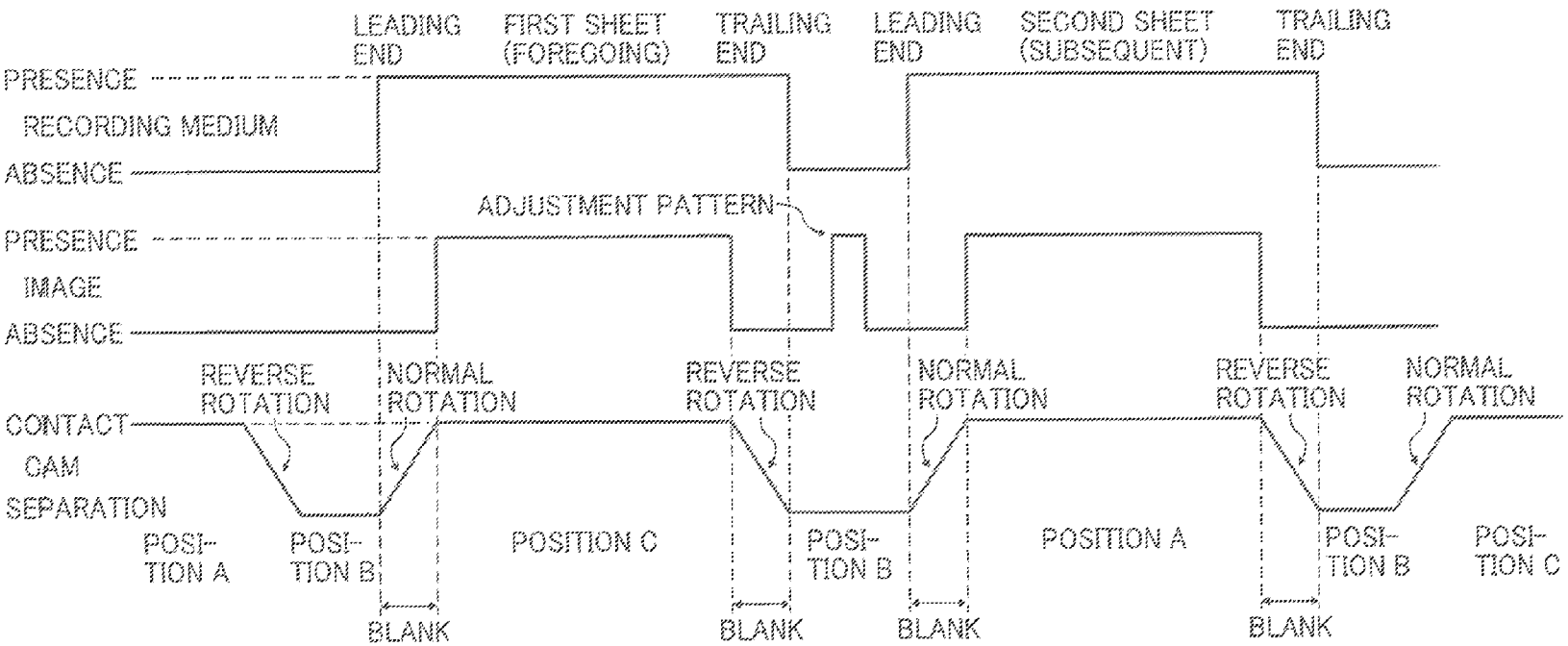
FIG. 12 is a time chart illustrating an exemplary sequence of a sheet, an adjustment pattern, and a position of a cam according to a second embodiment of the present invention.

Now, a second embodiment, in particular an exemplary sequence of a recording medium, an image and a cam position is described with reference to FIG. 12.

Different from the first embodiment even with the same configuration, a separation amount is controlled in accordance with a thickness of a recording medium when an adjustment pattern is similarly formed between sheets. In this embodiment, the controller 600 controls an operation of a cam driving motor 58 and rotation of cams 50 and 51 such that cam positions changes in an order of A, B, C, and B.

An exemplary sequence of the recording medium having a basic weight of about 300 gmm$^2$, an image, and a cam position is described. Initially, the cams 50 and 51 are located at a position A, so that the secondary transfer roller 30 and the belt surface 21*a* of the intermediate transfer belt 21 contact each other as shown in FIG. 11. Then, the cams 50 and 51 rotate and are located at the position B, serving as a separation position for a recording medium having 300 gmm$^2$, and disengages the secondary transfer roller 30 from the belt surface 21*a* of the intermediate transfer belt 21 before the recording medium enters therebetween. Subsequently, the cams 50 and 51 rotate again and are located at the position C to engage the secondary transfer roller 30 with the belt surface 21*a* when the next recording medium has entered, thereby transferring an image onto a recording medium. Then, the cams 50 and 51 rotate before ejection of the sheet and disengages the secondary transfer roller 30 from the transfer belt surface 21*a*. Even though the cams 50 and 51 are moved to the position D because the adjustment pattern is formed corresponding to the interval between the sheets in the first embodiment, they are moved to position B and disengage those as in the second embodiment. After passage of the adjustment pattern through the secondary transfer nip N under the separation condition and before entrance of a leading end of the subsequent sheet, the cams 50 and 51 rotate and are located at the position A and make the above-described contact, thereby transferring the image onto the recording medium.

With such a configuration, since toner is not transferred onto the secondary transfer member (i.e., an intermediate transfer belt 21) in an interval between sheets as in the first embodiment, a secondary transfer cleaning mechanism can be omitted, thereby downsizing an apparatus. Further, using the engaging and disengaging device 500 as a pushing down mechanism, a change in speed can be suppressed when a leading end of a sheet enters and a trailing end thereof exits therefrom. As a result, a poor image is not generated.

Now, a third embodiment is described with reference to FIG. 6, wherein a secondary transfer bias is turned off when an adjustment pattern is formed corresponding to an interval between sheets as only different from the second embodiment. Since the configuration of the apparatus is substantially the same as the first embodiment, only a difference of a relation between a sheet, a cam position, and a secondary transfer bias is described.

Figure 15:
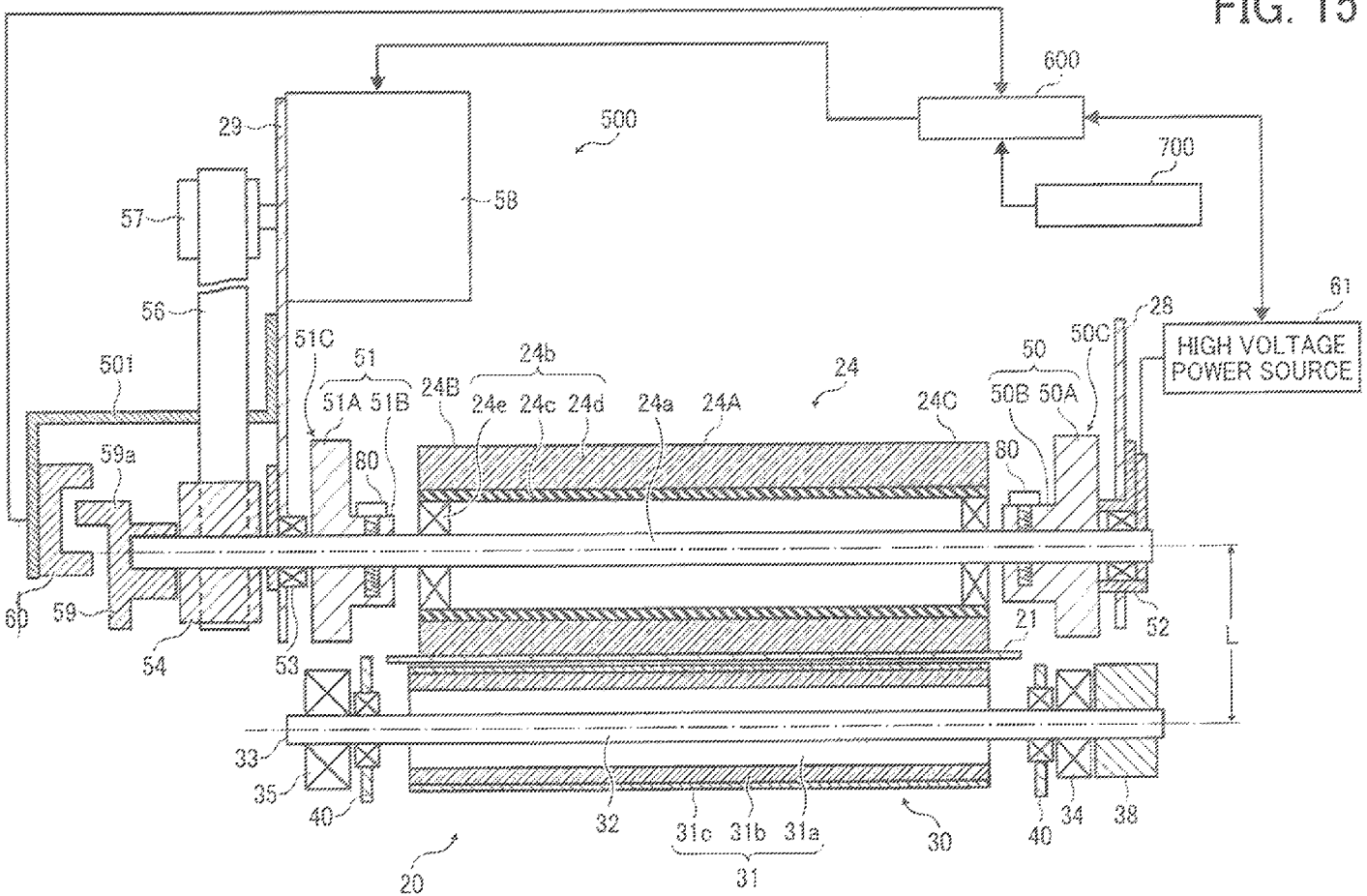
FIG. 15 is an enlarged view illustrating an exemplary secondary transfer nip and surroundings of a transfer device according to third and fourth embodiments of the present invention.

First, a repelling force transfer system is employed such that a secondary transfer bias is subjected to constant current control in an image section, while a bias having the same polarity as toner (e.g. a negative polarity) is applied to a secondary transfer opposed roller 24. Further, a constant voltage control is applied to a secondary transfer bias used for a non-image section and rotation of a cam. Such control of a secondary transfer bias is executed by connecting the controller 600 to a high voltage power source 61 with a signal line to control the high voltage power source 61 as shown in FIG. 15.

Figure 16:
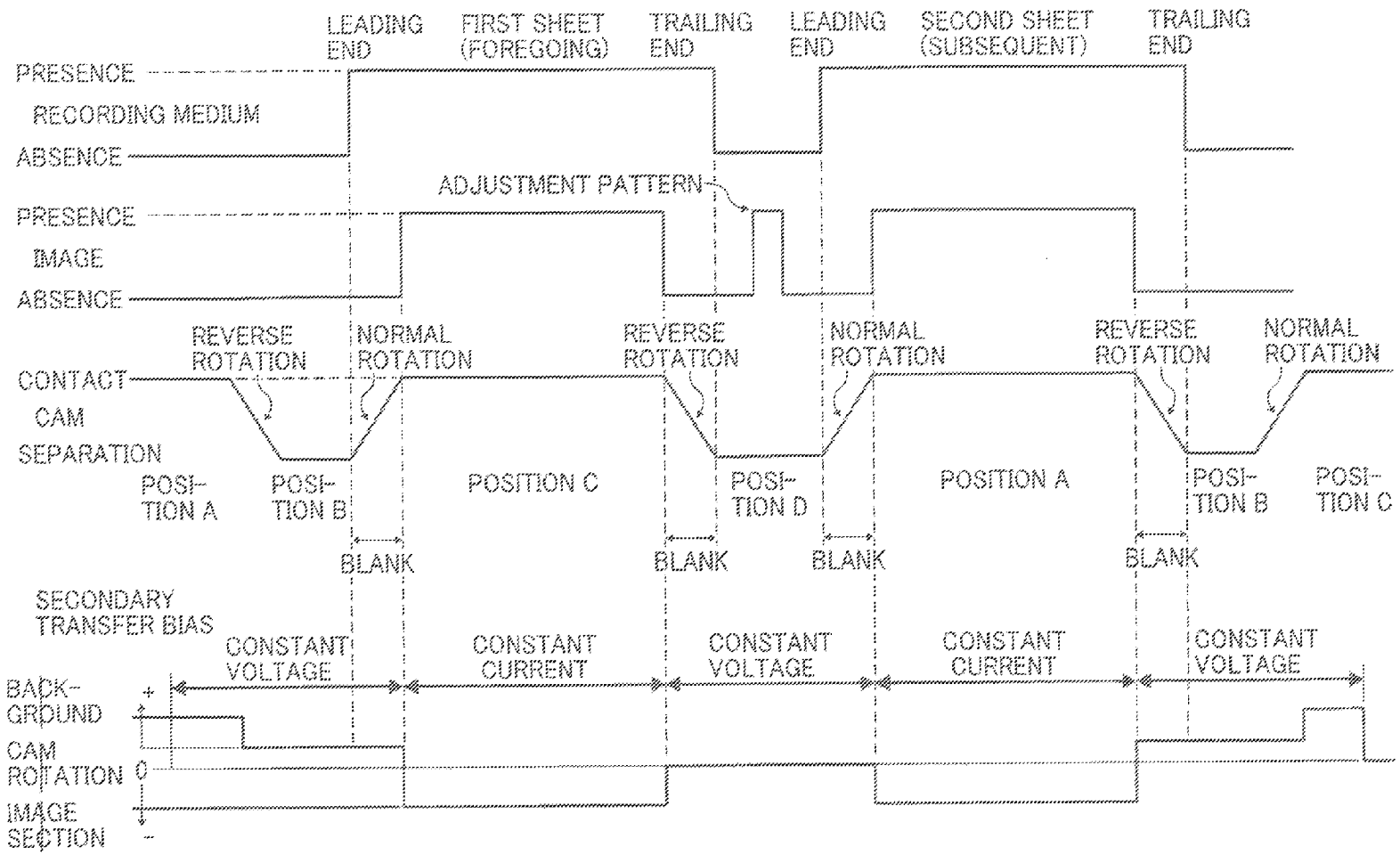
FIG. 16 is a time chart illustrating an exemplary sequence of a sheet, an adjustment pattern, a position of a cam, and a secondary transfer bias according to a third embodiment of the present invention.

FIG. 16 illustrates an exemplary sequence of sheets, images, positions of a cam, and a secondary transfer bias when two sheets of cardboard are fed. Specifically, the repelling force transfer system is employed in which a secondary transfer bias is subjected to constant current control in an image section, while a bias having the same polarity as toner (e.g. a negative polarity) is applied to a secondary transfer opposed roller 24. Further, a constant voltage control is applied to a secondary transfer bias used for a non-image section and rotation of a cam.

When printing for a first sheet is started, the secondary transfer roller 30 contacts the intermediate transfer belt 21, while the cams 50 and 51 are located at the position A. At that moment, a secondary transfer bias (e.g. +500V) is applied to a non-image section Subsequently, when a cardboard P2 approaches the secondary transfer nip N, the cams 50 and 51 start moving to the position B (generating a deviation amount of 1 mm). The secondary transfer bias changes a level (e.g. +200V) for a cam rotation in synchronizing with rotation of the cams 50 and 51. When the cams 50 and 51 arrive at the position B, the secondary transfer roller 30 disengages from the secondary transfer opposed roller 24. Then, a cardboard P2 is conveyed in such a separation condition. At the same time when the cardboard P2 arrives at the secondary transfer nip N, i.e., a leading end of the cardboard P2 enters thereof, the cams 50 and 51 start normal rotation clockwise, for example.

When a leading end of an image arrives at the secondary transfer nip N, the cams 50 and 51 move and stop at the position C. At the same time, the secondary transfer roller 30 contacts the secondary transfer opposed roller 24. The secondary transfer bias receives the constant current control, thereby becoming an image section current (e.g. −30 microampere, and −1000V of voltage application).

Subsequently, printing is performed by applying the image section transfer current under the condition that the secondary transfer roller 30 contacts the secondary transfer opposed roller 24. When a trailing end of the image arrives at the secondary transfer nip N, the cams 50 and 51 start reversing motion counter clockwise to execute separation. Synchronizing with the start of the reversing motion, the secondary transfer bias is changed to the cam rotation bias under the constant voltage control from the image section bias executed under the constant current control. Since an adjustment pattern is formed corresponding to an interval between sheets, the secondary transfer bias is tuned off to be nothing (i.e., zero). At that moment, the secondary transfer application voltage for the image section is −1000V, whereas that for a time when the adjustment pattern passes therethrough is zero volts. Specifically, an absolute value of the voltage applied when the adjustment pattern passes therethrough is smaller than that for the image section. When the trailing end of the sheet arrives at the secondary transfer nip N, the cams 50 and 51 move and stop at the position B. At that moment, the cam rotation bias is ordinarily switched to the non-image section bias in synchronism with the stop of motion of the cams. However, to form the adjustment pattern in an interval between sheets, the secondary transfer bias is nothing (i.e., zero) as in the cam rotation time period. Specifically, the adjustment pattern formed between sheets pass therethrough under the condition that the secondary transfer bias is turned off and the secondary transfer roller 30 disengages from the secondary transfer opposed roller 24.

Subsequently, the second sheet is conveyed to the secondary transfer nip N. When the leading end of the sheet arrives at the secondary transfer nip N, the cams 50 and 51 rotate to a opposite direction to that for the first sheet, i.e., counter clockwise, and the secondary transfer bias is synchronously changed to the cam rotation time period bias. However, the secondary transfer bias remains zero volts for the interval between sheets bearing the adjustment pattern. Subsequently, as executed in the first sheet, the second sheet printing is executed by disengaging and engaging the secondary transfer roller 30 with the secondary transfer opposed roller 24 and switching the secondary transfer bias synchronizing with the rotation of the cams. When the final sheet is printed, the cams 50 and 51 move and stop at the position C. At that moment, the non-image section bias is turned off and the printing is completed in synchronism with the stop of the cams.

According to the third embodiment, since toner is not transferred onto the secondary transfer member (i.e., an intermediate transfer belt 21) in an interval between sheets as in the first embodiment, a secondary transfer cleaning mechanism can be omitted, thereby downsizing an apparatus. Further, the depression mechanism provides a deviation amount in accordance with a thickness of sheet P2, a change in speed can be suppressed when the leading end of the sheet enters and the trailing end thereof exits therefrom. As a result, a poor image is not generated.

Now, a fourth embodiment is described with reference to FIG. 17, wherein an opposite bias to that applied when a toner image is transferred onto a sheet is applied when an adjustment patter is formed corresponding to an interval between sheets as different from that in the third embodiment.

Such a bias control is executed by a controller 600 that also controls a high voltage power source 61. Since a configuration of the apparatus and a time for applying a secondary transfer bias are the same to those in the third embodiment, description for them are omitted hereinafter, and a secondary transfer bias applied when an adjustment pattern is formed between sheets is only described.

Figure 17:
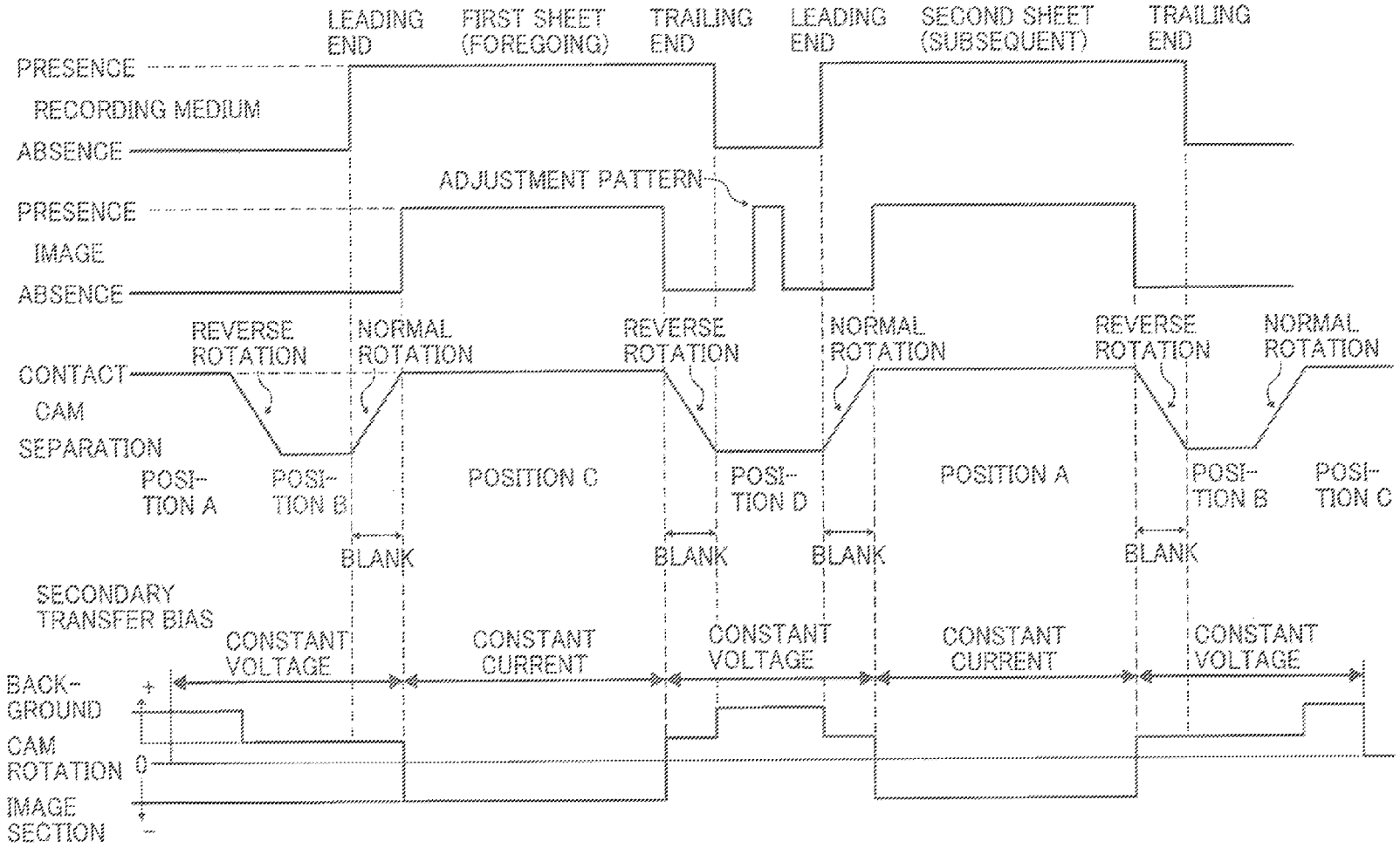
FIG. 17 is a time chart illustrating an exemplary sequence of a sheet, an adjustment pattern, a position of a cam, and a secondary transfer bias according to a fourth embodiment of the present invention.

FIG. 17 illustrates a sequence of a sheet, an image, a position of a cam, and a secondary transfer bias when two sheets of cardboard are fed in a system similar to that in the third embodiment. When image printing for the first sheet is completed, an adjustment pattern is formed corresponding to an interval between first and second sheets. Then, under a condition that the secondary transfer roller 30 contacts the secondary transfer opposed roller 24 via the intermediate transfer belt 21 and an image section current of −30 microA and −1000V of application voltage is applied, the first sheet is printed. When a trailing end of an image arrives at a secondary transfer nip N, the cams 50 and 51 start a reverse motion counter clockwise to are located at the position B and execute separation. In synchronism with the start of the reversing motion, the image section bias generated under the control of constant current is switched to the cam rotation time period bias generated under the control of the constant voltage. Specifically, an opposite bias to that applied during the sheet transfer time period is applied during a cam rotation time period at about +200V.

At that moment, the secondary transfer application voltage is −1000V in the image section. Whereas, it is +200V in the cam rotation time period. Specifically, the absolute voltage of the cam rotation time period is smaller than that for the image section. When the trailing end of the sheet arrives at the secondary transfer nip N, the cams 50 and 51 move and stop at the position B. At that moment, in synchronism with motion stop of the cams, the cam rotation time period bias is switched to the non-image section bias to prepare for passage of the adjustment pattern corresponding to an interval between sheets. The non-image section bias is opposite to that for the sheet transfer and is +500V. Thus, it is also smaller than the application voltage of −1000V for the image section.

Thus, the adjustment pattern formed corresponding to an interval as a result of the above-described operation passes through under conditions that the opposite secondary transfer bias to that for the sheet transfer is applied and the secondary transfer roller 30 disengages from the secondary transfer opposed roller 24.

When a leading end of the second sheet arrives at the secondary transfer nip N, the cams 50 and 51 start reverse rotation counter clockwise to the rotation for the first sheet. In synchronism with the start of the reversing motion, the secondary transfer bias is changed to the cam rotation time period bias of +200V. When the sheet has entered, in synchronism with driving of the cams, the cam rotation time period bias is changed to the image section bias. Then, the second sheet is printed and the printing is terminated.

According to the fourth embodiment, since toner is not transferred onto the secondary transfer member (i.e., an intermediate transfer belt 21) in an interval between sheets as in the third embodiment, a secondary transfer cleaning mechanism can be omitted, thereby downsizing an apparatus. Further, the depression mechanism provides a deviation amount in accordance with a thickness of sheet P2, a change in speed can be suppressed when the leading end of the sheet enters and the trailing end thereof exits therefrom. As a result, a poor image is not generated.

Now various comparative examples are described.

Figure 13:
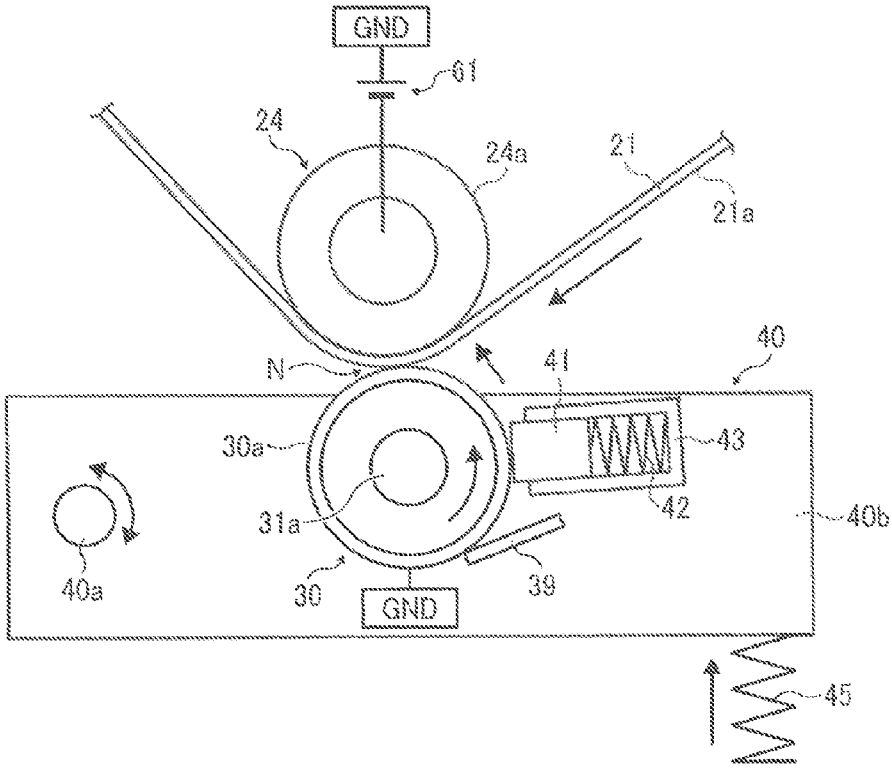
FIG. 13 is an enlarged view illustrating another exemplary secondary transfer nip and surroundings of a transfer device.

The first comparative example has the almost same configuration as the first embodiment but excludes the engaging and disengaging device 500 serving as the depressing mechanism for the secondary transfer roller. Thus, since the secondary transfer roller 30 always contacts the surface 21*a* of the intermediate transfer belt 21 when an image is printed, a cleaning mechanism is necessarily provided as shown in FIG. 13.

The second comparative example also has the almost same configuration as the first embodiment but excludes the depressing mechanism for the secondary transfer roller, wherein the secondary transfer roller 30 always contacts the surface 21*a* of the intermediate transfer belt 21 when an image is printed. However, as shown in FIG. 2, the cleaning blade 39 serving as a cleaning mechanism is omitted in the secondary transfer section.

The third comparative example also has almost the same configuration as the second comparative example, wherein the secondary transfer bias is turned off when an adjustment pattern is formed corresponding to an interval between sheets. Although the secondary transfer roller 30 always contacts the secondary transfer opposed roller 24, transfer onto the secondary transfer roller 30 of the adjustment pattern is suppressed by turning off the secondary transfer bias in the interval between sheets.

Figure 14:
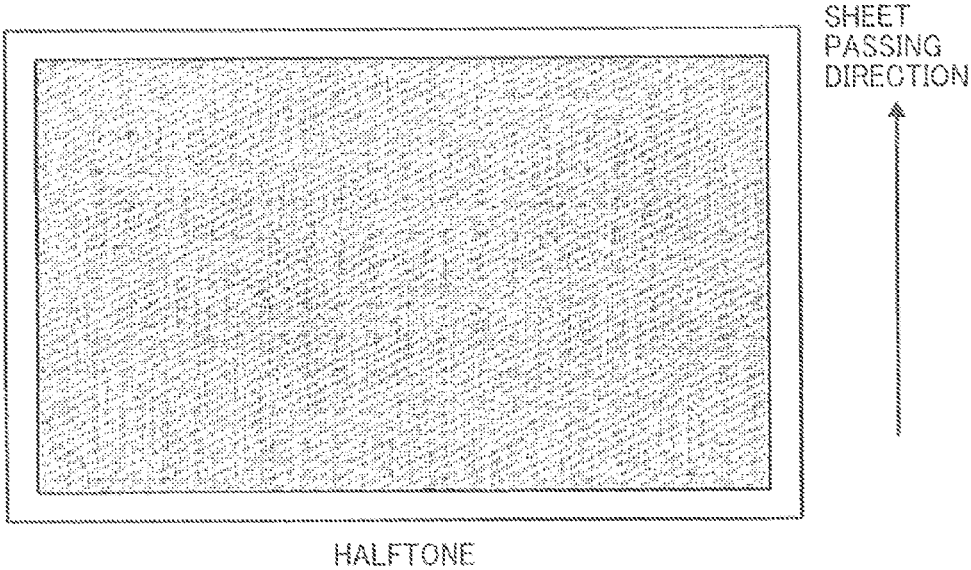
FIG. 14 illustrates an exemplary image pattern.

Sheet passage performance is experimented using the above-described first to fourth embodiments as well as the first to third comparative examples based on the below listed conditions, and their result is obtained as shown in a table of FIG. 18;

Number of sheets: A3 (JIS)—10 sheets—single side,

Adjustment Pattern: Once/three sheets—within interval between sheets,

Sheet: Manufactured by Mondi Co., Ltd. (Color Copy: Basic Weight 300 g/mm$^2$) (Color Copy: Basic Weight 160 g/mm$^2$), Image Pattern: Halftone Image shown in FIG. 14, and Evaluation Items: Abnormal Image in Image Section (Image deterioration by plunging of Sheet), and Stein of Rear side of Sheet.

See Table.

In the table, a circle represents absence of applicable abnormality. A triangle represents presence of abnormality, but is permissible. A crisscross represents presence of abnormality.

An abnormality of an image produced using the first to fourth embodiments falls within the permissible range, and in particular, no abnormality occurs in the second to fourth embodiments. By contrast, an image is deteriorated due to a change in speed of the intermediate transfer member caused by impact of the sheet entrance in the first comparative example. In addition to the image deterioration, rear side stein is caused by offset of the adjustment pattern formed corresponding to an interval between sheets and transferred onto the secondary transfer roller occurs in the second comparative example. Since the secondary transfer bias is turned off, an amount of the adjustment pattern formed between sheets and transferred onto the secondary transfer roller decreases than that in the second comparative example in the third comparative example.

However, the third comparative example cannot sufficiently eliminate the rear side stein.

The present invention is not limited to the copier as described heretofore, and can be applied to a facsimile, a printer, and a multi-functional system obtained by combining those of applicable devices. The image forming apparatus can be a four-cycle type or a single image bearer type rather than the tandem as described above.

Instead of the secondary transfer nip N where a recording medium P enters as described above, the present invention can be applied to another transfer system and an image forming apparatus incorporating the other transfer system in which primary transfer nips are formed by respective photoconductive members, an intermediate transfer belt 21, and primary transfer rollers 25C to 25K, while toner images T are conveyed therethrough. Further, the image forming apparatus can be a monochrome type rather that a full-color type as described above.

Although the cams engage and disengage with the secondary transfer roller 30 to adjust a gap X between the belt surface of the intermediate transfer belt 21 and the surface 30*a* of the secondary transfer roller 30 as described above, the secondary transfer opposed roller 24 can engage and disengage with the secondary transfer roller 30 by disposing the cams 50 and 51, a supporting mechanism supporting the cams, and a cam driving motor in the secondary transfer roller 30.

Instead of the secondary transfer opposed roller 24, the secondary transfer bias can be supplied from the high voltage power source 61 to the secondary transfer roller 30.

Numerous additional modifications and variations of the present invention are possible in latent image of the above-described teachings. It is therefore to be understood that within the scope of the appended claims, the present invention may be practiced otherwise that as specifically described herein.

What is claimed is:

1. An image transfer system comprising:

an image bearer to bear an image to be transferred onto a recording medium;

an opposed member opposed to the image bearer to form a transfer nip therebetween, said opposed member having a contact surface contacting the recording medium at the transfer nip;

a pressing device to apply pressure to the transfer nip;

an engaging and disengaging device to engage and disengage the contact surface of the opposed member from a surface of the image bearer; and a transfer bias device to apply an image transfer bias transferring the image from the image bearer to the recording medium conveyed and pinched at the transfer nip, wherein said engaging and disengaging device disengages the contact surface of the opposed member from the surface of the image bearer to make a gap therebetween when an adjustment pattern is formed on a portion of the image bearer corresponding to an interval between recording mediums successively conveyed through the transfer nip and passes therethrough, wherein said transfer bias device applies a different bias than the image transfer bias between the image bearer and opposed member when the adjustment pattern passes therebetween, wherein said engaging and disengaging device includes:

a cam having at least two different diameter portions changing a size of the gap when rotated;

a cam driving device to rotate and stop the cam; and a cam controller to control the cam driving device, said cam controller controls the cam driving device to rotate and stop the cam at a first rotation angular position minimizing the gap when the adjustment pattern passes therethrough.

2. The image transfer system as claimed in claim 1, further comprising a bias controller to control the transfer bias device, wherein said bias controller instructs the transfer bias device to stop applying the transfer bias when the adjustment pattern passes therethrough.

3. The image transfer device as claimed in claim 2, wherein said transfer bias is turned on and off synchronizing with the rotation of the cam.

4. The image transfer system as claimed in claim 1, further comprising a bias controller to control the transfer bias device, wherein said bias controller instructs the transfer bias device to apply a bias having a prescribed polarity to the transfer nip when the adjustment pattern passes therethrough, said polarity being opposite to that of an image transfer bias applied when an image is transferred onto the recording medium.

5. The image transfer device as claimed in claim 4, wherein an absolute value of said opposite bias is smaller than that of the image transfer bias.

6. The image transfer device as claimed in claim 1, wherein said gap is broadened repelling the opposed member against the pressure by rotating and stopping the cam at a second rotation angular position before exit of a trailing end of a former recording medium passing through the transfer nip therefrom.

7. The image transfer device as claimed in claim 1, wherein said gap is narrowed by rotating and stopping the cam at a third rotation angular position before entrance of a leading end of the subsequent recording medium into the transfer nip.

8. An image transfer system comprising:

an image bearer to bear an image to be transferred onto a recording medium;

an opposed member opposed to the image bearer to form a transfer nip therebetween, said opposed member having a contact surface contacting the recording medium at the transfer nip;

a pressing device to apply pressure to the transfer nip;

an engaging and disengaging device to engage and disengage the contact surface of the opposed member from a surface of the image bearer; and a transfer bias device to apply an image transfer bias transferring the image from the image bearer to the recording medium conveyed and pinched at the transfer nip, wherein said engaging and disengaging device disengages the contact surface of the opposed member from the surface of the image bearer to make a gap therebetween when an adjustment pattern is formed on a portion of the image bearer corresponding to an interval between recording mediums successively conveyed through the transfer nip and passes therethrough, wherein said transfer bias device applies a different bias than the image transfer bias between the image bearer and opposed member when the adjustment pattern passes therebetween, wherein said engaging and disengaging device includes:

a cam having at least two different cam portions changing a size of the gap when rotated;

a cam driving device to rotate and stop the cam; and a cam controller to control the cam driving device, said cam controller controlling the cam driving device to rotate and stop the cam at a prescribed rotation angular position changing the gap in accordance with a thickness of the recording medium, and wherein the image transfer system further includes a bias controller to control the transfer bias device, said bias controller controlling the transfer bias device to stop applying the bias when the cam is rotated and stops at a prescribed rotation angular position broadening the gap and the adjustment pattern passes therethrough.

9. The image transfer device as claimed in claim 8, wherein said gap is broadened by rotating and stopping the cam at a second rotation angular position repelling the opposed member against the bias force before exit of a trailing end of a former recording medium from the transfer nip.

10. The image transfer device as claimed in claim 8, wherein said gap is narrowed by stopping the cam at a second rotation angular position before entrance of a leading end of the subsequent recording medium into the transfer nip.

11. The image transfer device as claimed in claim 8, wherein the transfer bias is switched synchronizing with rotation of the cam.

12. An image transfer system comprising:

an image bearer to bear an image to be transferred onto a recording medium;

an opposed member opposed to the image bearer to form a transfer nip therebetween, said opposed member having a contact surface contacting the recording medium at the transfer nip;

a pressing device to apply pressure to the transfer nip;

an engaging and disengaging device to engage and disengage the contact surface of the opposed member from a surface of the image bearer; and a transfer bias device to apply an image transfer bias transferring the image from the image bearer to the recording medium conveyed and pinched at the transfer nip, wherein said engaging and disengaging device disengages the contact surface of the opposed member from the surface of the image bearer to make a gap therebetween when an adjustment pattern is formed on a portion of the image bearer corresponding to an interval between recording mediums successively conveyed through the transfer nip and passes therethrough, wherein said transfer bias device applies a different bias than the image transfer bias between the image bearer and opposed member when the adjustment pattern passes therebetween, wherein said engaging and disengaging device includes:

a cam having at least two different cam portions changing a size of the gap when rotated;

a cam driving device to rotate and stop the cam; and a cam controller to control the cam driving device, said cam controller controlling the cam driving device to rotate and stop the cam at a prescribed rotation angular position changing the gap in accordance with a thickness of the recording medium, and wherein the image transfer system further includes a bias controller to control the transfer device, said bias controller controlling the transfer bias device to apply a bias having an opposite polarity to that of an image transfer bias applied for transferring an image onto the recording medium when the cam is rotated and stops at a prescribed rotation angular position broadening the gap and the adjustment pattern passes therethrough.

13. The image transfer device as claimed in claim 12, wherein an absolute value of said opposite bias is smaller than that of the image transfer bias.

14. An image forming apparatus including an image transfer system, said image transfer system comprising:

an image bearer to bear an image;

an opposed member having a contact surface contacting a recording medium, said opposed member being opposed to a surface of the image bearer and forming a transfer nip therebetween;

a biasing device to apply a biasing force to the transfer nip;

an engaging and disengaging member to engage and disengage the contact surface from the surface of the image bearer;

a transfer bias device to apply transfer bias transferring an image formed on the image bearer onto the recording medium conveyed and pinched at the transfer nip, wherein said image is composed of an adjustment pattern formed on a portion of the image bearer corresponding to an interval between recording mediums successively conveyed through the transfer nip, said engaging and disengaging device disengaging the contact surface from the surface of the image bearer to form a gap therebetween when the adjustment pattern passes therethrough, and wherein the engaging and disengaging member includes:

a cam having a first cam portion which forms a first gap between the image bearer and the contact surface, and a second cam portion which forms a second gap between the image bearer and the contact surface, the second gap being smaller than the first gap;

a cam driving device to rotate and stop the cam; and a cam controller to control the cam driving device such that when the adjustment pattern is not formed in between the recording media successively conveyed through the transfer nip, the first gap is formed between the image bearer and the contact surface, and when the adjustment pattern is formed on the portion of the image bearer corresponding to the interval in between the recording media successively conveyed through the transfer nip, the second gap is formed between the image bearer and the contact surface.

* * * * *